US006175066B1

(12) United States Patent
McCabe

(10) Patent No.: US 6,175,066 B1
(45) Date of Patent: Jan. 16, 2001

(54) TUNING MEANS FOR STRINGED MUSICAL INSTRUMENT

(76) Inventor: Geoffrey McCabe, 36 E. 7th St., New York, NY (US) 10003

( * ) Notice: Under 35 U.S.C. 154(b), the term of this patent shall be extended for 0 days.

(21) Appl. No.: 08/027,729

(22) Filed: Jan. 14, 1993

Related U.S. Application Data

(62) Division of application No. 07/607,458, filed on Oct. 31, 1990, now Pat. No. 5,198,601.

(51) Int. Cl.[7] ..... G10D 3/00
(52) U.S. Cl. ..... 84/313
(58) Field of Search ..... 84/298, 307, 313

(56) References Cited

U.S. PATENT DOCUMENTS 4,457,201 * 7/1984 Storey ..... 84/313
4,724,737 * 2/1988 Fender ..... 84/313
4,742,750 * 5/1988 Storey ..... 84/313
4,955,275 * 9/1990 Gunn ..... 84/313
5,088,374 * 2/1992 Saijo ..... 84/313

* cited by examiner

*Primary Examiner*—Cassandra C. Spyrou
(74) *Attorney, Agent, or Firm*—Dann, Dorfman, Herrell and Skillman; Stephen H. Eland

(57) ABSTRACT

A stringed instrument is provided wherein each string has two critical points. A fulcrum tremolo is mounted on the instrument for varying the tension of the strings and the distance between the two critical points. The strings are attached to a plurality of intonation modules mounted on the fulcrum tremolo. Each intonation module is adjustable so that the strings can be adjusted from an untensioned state to a proper playing pitch. A bearing assembly is also included to facilitate pivoting of the fulcrum tremolo.

12 Claims, 12 Drawing Sheets

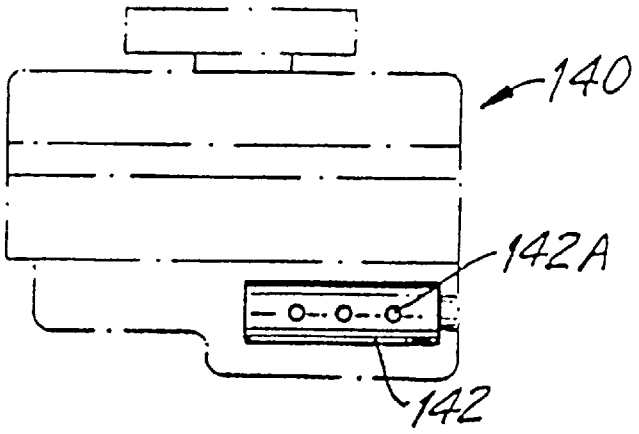
FIG. 9A
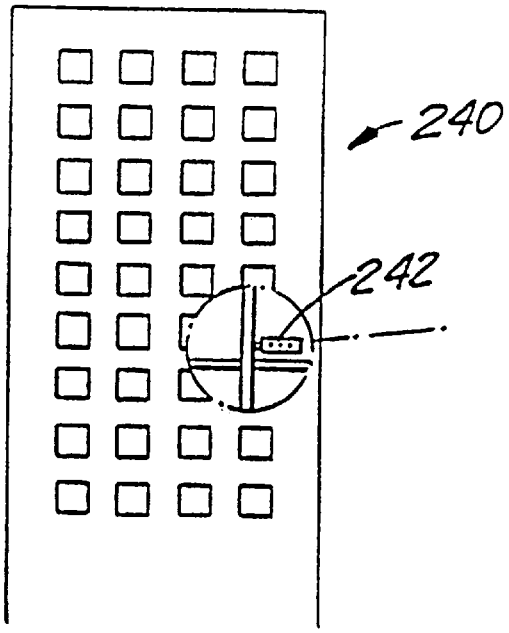
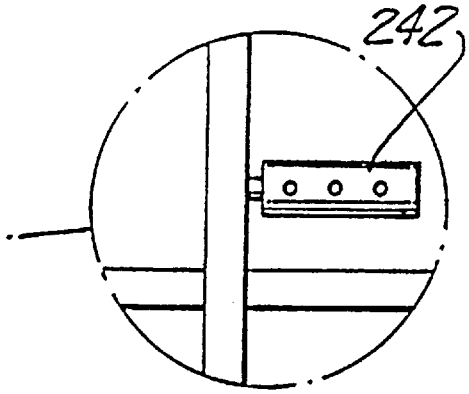
FIG. 9C
FIG. 9B

TUNING MEANS FOR STRINGED MUSICAL INSTRUMENT

This Application is a division of Application 607,458, filed Oct. 31, 1990 now U.S. Pat. No. 5,198,601.

BACKGROUND OF THE INVENTION

The present invention is directed to the tuning of a stringed musical instrument, such as a guitar. Further, it is directed to the use of free-to-vibrate parts in such an instrument for reinforcing and enhancing the vibrating characteristics of the instrument.

Basically, a stringed musical instrument is a hollow wooden box serving as a support for a number of strings secured in tension on an outside surface of the box. When the strings are plucked or bowed, they produce complex vibrations transmitted through the bridge or string supports to the wooden box causing its various surfaces to oscillate and setting in motion the air within, and surrounding the box, causing audible sound. obtaining the desired musical effect can be very difficult. In completely acoustic instruments, as compared to instruments using electronic means for amplification and modifying the tone of the instrument, such as those belonging to the violin family and the folk guitar, the wooden box is constructed to oscillate at a number of determined broad resonances for reinforcing the corresponding range of notes played on the instrument. When the tuning of the instrument is maintained, it will have an apparent increase in volume and sustain and generally will be more pleasing to the ear.

In a stringed musical instrument, such as a guitar, the strings extend unsupported between a first critical point on a neck of the guitar and a second critical point on the guitar body. The first critical point is usually formed by a nut supported in the neck. Generally, the second critical point is formed by a bridge element constituting part of a bridge or a combined bridge and tailpiece assembly. Traditionally, the size of the bridge elements is quite small and functions to clearly define the second critical point and can range from a narrow edge to a rounded surface with a diameter no larger than about 5/32". The strings are typically secured beyond the nut by tuning keys and beyond the bridge element by the tailpiece or tailpiece portion of a bridge and tailpiece assembly. Fine tuning the strings has long been a problem for guitars.

In fine tuning or changing the pitch of a string, two different operations are carried out. In one operation, the length of the string between the first and second critical points is adjusted, such as between the nut and the bridge element, and this is known as harmonic tuning. The second operation involves increasing or decreasing the tension on a given string for raising or lowering the string pitch. This second operation is generally characterized as pitch tuning. In practice, initially harmonic tuning is carried out and then pitch tuning.

A problem existing in tuning the strings is that the two different tuning operations tend to conflict. In harmonic tuning, the pitch is lowered when the distance between the critical points is increased and, conversely, when the distance is shortened, the pitch is raised. In pitch tuning, when the tension is increased, the pitch is raised and when the tension is decreased, the pitch is lowered. These different operations present difficulties in pitch tuning and maintaining the tuned condition of a stringed musical instrument.

When a fulcrum tremolo is used, there is the tendency when increasing string tension and raising of pitch, also to increase the length of the string, and, conversely, when decreasing string tension and lowering pitch, also to decrease the string length. Accordingly, when using a fulcrum tremolo, these counteracting features are not always balanced.

With the development of the fulcrum tremolo, that is, where the bridge plate is pivoted to provide a tremolo or vibrato effect, the problem of maintaining an effective pivoting action and assuring the return of the bridge plate to an initial position has presented problems. Often, the solution of one problem in pivoting the bridge plate has resulted in the introduction of another problem. As an example, when the bridge plate is pivoted, there is a tendency to upset the harmonic tuning of the strings. Further, the pivot support of the bridge plate, such as disclosed in the Rose U.S. Pat. No. 4,171,661, presented problems in maintaining the proper pivoting action, in returning to the original tuned position, in limiting the range of pivotal movement, and in maintaining the pivot means free from wear. If pivoting of the bridge plate results in wear of the surfaces at which the pivoting action takes place, friction is introduced into the movement of the bridge plate which interferes with its return to the initial position and original tuning.

Combination bridge and tailpiece assemblies have been known for some time. In the Kaufman U.S. Pat. Nos. 1,839,395 and 2,241,911 and in the Beauchamp U.S. Pat. No. 2,152,738, such assemblies were disclosed affording means for varying the tension on the strings and creating a tremolo effect.

In the Proelsdorfer U.S. Pat. No. 2,304,587, string tensioning devices placed on the tailpiece for fine tuning the pitch of the strings of violins, guitars and the like, were disclosed, however, such pitch adjustment is quite limited in range and designed to offer minor adjustment of pitch rather than raising and adjusting from an untensioned condition the strings by the tuners placed on the head of the instrument.

The first fulcrum tremolo combining the bridge and tailpiece was set forth in the Fender U.S. Pat. No. 2,741,146. In this patent, a bevelled ridge portion of the base plate was secured to the instrument body by six screws for permitting limited pivotal movement about the fulcrum and thereby varying the tension on the strings and producing the desired tremolo effect. The strings were supported in the traditional manner on top of the base plate by bridge elements adjustable in height and for string lengths, that is, harmonic tuning. As in known combination bridge and tailpiece assemblies, the strings extend vertically through openings behind the bridge elements and are secured in the tailpiece which in this case also functions to receive the string tensioning biasing springs.

In the Rose U.S. Pat. Nos. 4,171,661 and 4,497,236, two improvements were established. In one improvement, the bevelled ridge portion of the base plate was arranged so that it could be received and held in a tapered slot between the head of the screw and a flanged shoulder, thereby increasing the range of pitch change and improving the return to the initial tuned position and provided for lateral height adjustment of the tremolo. The other improvement involved functionally and physically integrating the bridge elements with the known art of combining fine tuners with anchoring means. In effecting the fine tuning, the bridge elements were provided with a constant radius, so that harmonic tuning would not be effected when establishing fine tuning, however, fine tuning is limited to a range of about two musical pitches and is inadequate for bringing the strings to proper pitch for compensating string stretch, or achieving common alternate tuning commonly requiring a larger range of pitch change.

In the Shiboya U.S. Pat. No. 4,383,466, a pin was located in a hinge pivot to improve the return to the initial tuned position. This arrangement did not offer lateral height adjustment of the base plate and the field of rotation was not as great as in the Rose improvement.

With these various improvements, a number of problems remained in the known fulcrum tremolo related to the bridge element and its movement when the tremolo is pivoted. Since the second critical point is offset from the pivot axis, initially there is a tendency for the string height at the bridge to decrease when the base plate is pivoted toward the body with the strings contacting the finger board and causing an undesirable buzzing noise and/or deadening the sound of the strings. This phenomenon limits upward pitch change. In addition, there is a tendency for string length to increase when the pitch is raised and for the string length to decrease with the pitch is lowered acting counter to the desired effect. Furthermore, the different diameters and constructi on of the strings on the instrument cause the strings to stretch at different rates and lose pitch relationship.

Concerning this last problem, several improvements have been proposed in the Steinberger U.S. Pat. No. 4,632,005, the Jones U.S. Pat. No. 3,411,394 and the Hussino U.S. Pat. No. 4,648,304, however, none of them are directed toward the fulcrum tremolo. In the installation of the fulcrum tremolo, there is a problem in routing the cavity to receive the tremolo. At least one routing has been required for the biasing springs. A further problem experienced in guitars and, particularly, in electric guitars is establishing a formant where the various resonances of the instrument co-act with the vibrations of the strings to enhance playing quality. Due to centuries of trial and error in the development of the violin body, a very sophisticated formant has been achieved. This has not been the case for the guitar. Particularly in electric guitars, the wooden box can cause unwanted feedback, so that volume of the cavity in the wooden box is often reduced or completely eliminated, as in the case where a solid body is used. As a result, electric guitars depend greatly on electrical amplification for both volume and tone. In the current design theory of electric guitars, the use of metal and especially of steel bridges contribute such mass that it prevents what little resonances the rest of the instrument possesses from having much effect. Accordingly, the tone of such instruments is limited for the most part by the vibrational characteristics of the strings. Another problem is that some players tend to rest their hand on the fulcrum tremolo while playing and inadvertently move the tremolo and detune the instrument.

In stringed musical instruments, the vibration of the strings in combination with the other parts of the instrument, combine to provide the desired tone or sound of the instrument. In the U.S. Pat. No. 3,353,433, to J. D. Webster, a tuning fork is incorporated with a floating bridge arrangement. The bridge arrangement depends from the tuning fork and is supported entirely by the strings of the instruments. Accordingly, when the strings are plucked and set into motion the tuning fork is activated and in turn feeds energy hack through the bridge arrangement to the strings, the purpose of which is to keep the strings vibrating as long as the tuning fork vibrates. However, the actual pitch and strength or the vibrating of the tuning fork were not adequately considered and the result was unbalanced at best.

In conventional stringed instruments tuning pegs secure the strings at the head of the instrument. The pegs have an opening through which the string is passed and then tied. Problems exist for conventional peg tuning, such as the amount of peg tightening required and the need for adjustment to compensate for on-going tuning and normal string stretch which takes place during use. As a result, fine tuners have been provided on the bridge or tailpiece. Further, often there is a relatively long distance between the nut and the tuning pegs where the string bends causing unequal tension on opposite sides of the nut and tuning problems. One proposed solution employs string clamps on the nut, however as often happens the string stretches beyond the adjustment range, of the fine tuners. Accordingly, the required correction, is tedious and time consuming involving unclamping, readjusting of the clamp, returning, reclamping and further readjustment.

SUMMARY OF THE INVENTION

Therefore, one primary object of the present invention is to provide a stringed musical instrument with an improved arrangement for both harmonic tuning and fine tuning of the instrument.

Another primary object of the invention is to provide a sophisticated set of tuned resonances added to the bridge or the combination bridge and tailpiece assembly of the stringed musical instrument, as a functional analogue to the sophisticated formants found in the violin which improve the sustain and resonant quality of the instrument.

Common objects, such as an odd shaped piece of metal when dropped or struck, and set into vibration, usually have an unpleasant or harsh sound. This is characterized by a low tone referred to as the fundamental which can be one specific frequency or several frequencies defining a broad resonance and higher tones or secondary resonances referred to as harmonics. The irregular mathematical relationship between the frequencies of these tones causes the harsh sound as reflected by the irregular shape of the object.

In the case of a metal bar with parallel sides the tone is more pleasing and by removing mass from the middle of the bar the frequencies of higher tones can be tuned to whole number multiples of the frequency of the lower tone as is done in marimbas and xylophones, and the like.

In another variation, strips of metal tightly coupled at one end to a gourd or a similarly fashioned hollow object comprise the African "thumb piano", however, there has been no effort to tune the upper tones to the lower tones and such metal times are directed to producing tones for the instrument, like the strings on a guitar for example, and not for the modification of the resonances of the hollow portion, like the body of the stringed instrument such as a violin. It is known that such a bar tightly coupled at one end has two higher tones that are $6.27 \times F_1$ (fundamental) and $17.55 \times F_1$, respectively. The tuning fork is actually two bars joined together at one end with each vibrating at approximately the same fundamental. When the fork is tightly coupled to another object the second harmonic drops very close to the fundamental and communicates its vibratory character to the object to which it is coupled. Single bars communicate an influence dependant on the ratio of mass between the bar and the object it is coupled to.

As with the bars of the xylophone, changing the shape of the vibrating object tightly coupled at one end creates the means for functionally tuning its resonant frequencies.

The overall length of the free-to-vibrate portion generally defines the frequency of the lowest tone. Transverse slots can be used to define length. A blind bore in the free end can define the effective length as well.

If the opposite surfaces are tapered toward one another the lowest tones form a broad resonance comprised of many weak frequencies surrounding a strong frequency. Parallel surfaces create one focused low frequency. Removing mass is another way of tuning the higher tones. These recesses can be holes, and when placed close together can form "oval" openings or expanded to slots. Added weight can be used to lower the fundamental resonances whether permanently affixed or adjustable in position.

These means of modifying the character of bars tightly coupled at one end are applicable to changing harmonic content of tuning forks.

A tuning fork or tuning fork-like apparatus of sufficient mass can redefine the resonances of any object to which it is tightly coupled. Additional free-to-vibrate portions of sufficient mass can be tightly coupled to the tuning fork-like apparatus for adding additional resonances. Such a combination can be effective in defining the resonant qualities of any object subject to vibration such as musical instruments.

A further object is to provide individual intonation modules for each string of the instrument affording separate means for the adjustment of harmonic tuning of the bridge portion of the module and macro-tuning of the string attached to the tailpiece portion of the module providing the capacity to bring the strings to proper tension and a tuning range of greater than an octave for use with but not exclusive to "headless" stringed musical instrument, that is, instruments without tuners placed on the head of the instrument.

A further object is to provide two tapered free-to-vibrate portions approximately the same and each with two holes for creating secondary resonances two and three times the strong frequency in the broad resonance and each of approximately the same fundamental resonance tightly coupled to one another and to a musical instrument such that the responsiveness of the musical instrument is defined with no significant resonant peaks or dips other than those created by this tuning fork-like portion.

A further object is that the strong frequency of the tuning fork-like portion is tuned to a pitch of the instrument. For example, it could be a B♭ (B Flat) for a $B^b$ saxophone or $E_2$ or whole number multiple thereof, specifically for this embodiment designed for guitar.

A further object is that the adjustment of the strong frequencies of the tuning fork-like portion is effected either by a set screw in a blind bore in the free end or by a slidable member.

Yet another object, in addition to the tuning fork-like portion, is to provide six additional tapered free-to-vibrate portions coupled to a musical instrument each with a long slot and a broad resonance of an effective range covering a major third (for example concert C to E on the piano) and which strong frequency is tuned between two pitches, (for example between concert C and D flat on the piano) and which slot creates secondary resonances in whole number multiples of the strong frequency.

A still further object is to provide each of six additional free-to-vibrate portions with a different strong frequency spaced a major third from each other and in concert with the secondary resonances, for reinforcing each note on the instrument in a balanced sensitive and responsive manner. The strong frequency in the broad resonance in the series can be tuned to between 220 hz and 390 hz.

Yet another object of the invention is to provide an improved bearing arrangement for a fulcrum tremolo for assuring the proper and wide range of pivotal movement of the tremolo while limiting wear or friction which would tend to defeat the effectiveness of the tremolo.

Still another object is to provide means for limiting the pivoting of the tremolo towards the body.

An additional object is to provide free-to-vibrate portions for a broad range of devices In the descriptor of the invention the following, terms are used and are defined to assure a proper understanding of the terminology employed.

Resonance refers to vibrations of large amplitude within an object subject to vibration, such as a stringed musical instrument. Other instruments or apparatus are also subject to vibration. In the following description of the invention, an electric guitar is used as the item subject to vibration, however, the invention is also applicable to other vibrating instruments and apparatuses.

Resonant frequency is the frequency of an object subject to vibration when set into motion such that it produces a greater response.

Concert tuned pitch is a pitch derived from a commonly accepted standard, for example, A=440 hz.

The musical interval of a major third is the distance of five musical tones, for example, concert C to E on the piano.

Macro-tuners refer to tuners with the capacity to raise and adjust from an untensioned condition strings to proper playing pitch, providing for alternate tunings, and compensation for substantial string stretch during the life of the string essentially without additional means.

Resonant frequencies are the frequencies where the object subject to vibration has more than one mode of vibration.

Fundamental resonant frequency is the lowest resonant frequency in an object subject to vibration.

Secondary resonant frequencies are the frequencies other than the fundamental.

Overtones, or partials, are resonances of various amplitudes above the fundamental resonant frequency.

Coupled is the connection provided between two vibrating objects which influence one another when they are subject to vibration. The coupled condition can be a loose coupling where the resonances of each object remains unchanged or a tight coupling where the resonances of each object interact very strongly.

Hertz is a unit of frequency of a periodic process equal to one cycle per second.

$E_3$ is usually defined as 164.81 hz when $A_4$ is defined as 440 hz by the International Standards Organization; although in Europe and other parts of the world $A_4$ can vary by up to 25 hz. By this standard $B\flat_3$ is 233.08 hz, $B_3$ is 246.94 hz, $D_4$ is 293.66 hz and E♭ is 311.13 hz, etc.

Free-to-vibrate refers to a tuned member coupled to another member and having a portion not coupled or in engagement with the other object.

A tuning fork has two tightly coupled free-to-vibrate bars or sections of approximately the same frequency for creating one fundamental resonance frequency with the first harmonic very close to the fundamental and a second harmonic approximately sixteen times the frequency of the fundamental frequency so that no resonant peaks or dips are present between the fundamental resonant frequency and the harmonics. A tuning fork also has the capacity to impart these characteristics to any object to which it is tightly coupled.

A formant is a fixed array of resonances in which the frequency of the harmonics of the object subject to vibration are emphasized regardless of the fundamental frequency of the vibrational influence on the object.

In a guitar, the strings extend unsupported between a first critical point at the nut mounted in the neck of the guitar and a second critical point at the bridge mounted on the body of the guitar.

In accordance with the present invention, a guitar, preferably an electric guitar, has a body with a neck extending outwardly from the body; usually six strings extend at least from the nut on the neck spaced from the body to some form of anchorage beyond the bridge and mounted on the body. A fulcrum tremolo assembly is mounted over a cavity in the body so that a part of the assembly can be pivoted into the cavity when the tremolo is actuated.

The bridge and tailpiece assembly includes a base plate mounted on the body. The base plate mounts six intonation modules, each arranged to secure one of the strings in its tailpiece portion and to effect the harmonic tuning of the strings. In addition, a wing-like member is located along each of the sides of the base plate, extending in the direction of the strings. Each wing-like member has a first end closer to the neck and a second end more remote from the neck. Adjacent the first end, the wing-like member is directly connected or tightly coupled to the base plate. The wing-like member has a section extending in the direction of the strings from the connected part, away from the neck. The wing-like section has a lower surface facing the body and the lower surface can be tapered upwardly to the rearward free end of the section. The wing-like members are located laterally outwardly from the cavity in the body. Because of their shape, when the bridge plate is pivoted, the wing-like members do not interfere with the pivoting action and do not contact the surface of the body. In the intonation modules the bridge element is functionally separate and physically distanced from the tailpiece portion.

At the connected first end of the wing-like members, the base plate is pivotally supported in a bearing assembly containing ball bearings adjustably mounted so that the plate can be variably spaced from the surface of the body. The bearing assembly includes a self-aligning means to accommodate the variable adjustment of the base plate. Further, instead of at the sides, it is possible to locate the pivot point or pivot axis for the base plate along the front side of the plate facing toward the neck.

Also by using self-aligning bearings or a bearing affording a universal joint type movement, it is possible effectively to pivotally support the base plate, when its axis is not parallel with the surface of the body.

As compared with the knife-edge pivot support of the fulcrum tremolo disclosed in the Rose U.S. Pat. No. 4,171,661, it is possible to limit the wear of the bearing so that unnecessary friction is not developed which would interfere with the return of the base plate to its initial position. In its initial position, the base plate is fine tuned. When the tremolo is pivoted to provide a vibrato effect, the tension on the strings is increased or decreased. When the tremolo arm is released, the tremolo should return to its initial position so that its fine tuned condition is maintained. If the bearing arrangement for the base plate should prevent its return to the initial position, then further adjustment would be needed. In accordance with the present invention, however, ball bearings assure that the bridge assembly returns to the initial position and that wear does not take place which would interfere with the pivotal movement, and offers a greater field of rotation for the largest possible pitch chance.

Existing acoustic physics indicates when two vibrating objects are "tightly" coupled, the resonances of one will influence the resonances of the other. A free-to-vibrate portion of an object set into motion will adopt a resonant frequency and resonances defined primarily by its length and mass. The addition or reduction of mass and its subsequent location along a defined length will change the pitch of the resonant frequency and resonances. Accordingly, the resonant frequency and resonances of an object can be changed based on the characteristics of the free-to-vibrate portion of the other object. As a result, by selecting the structure of the free-to-vibrate portion, it is possible to adjust resonant frequencies in objects subject to vibration.

The control of vibrations has a broad application, not only in musical instruments, such as stringed instruments, but also in speakers and microphones. Moreover, for creating less conflicting energy, such as in engines for vehicles such as motor cars. The control of vibrations can be employed in any device subject to vibration, particularly where the vibrations may tend to have a deleterious effect.

The use of free-to-vibrate portions or elements has preferred application in musical instruments, especially stringed musical instruments.

Musical instruments have tuned resonances for augmenting the energy of a vibrating source. In stringed instruments, a hollow box, usually a wooden box, serves as a support for a number of strings maintained under tension. The box is designed so that its surfaces oscillate producing vibrations in the air within and surrounding it, so that the sound of the vibrating strings are amplified and audible. The oscillating surfaces are arranged to have resonances for reinforcing the vibrations of the strings. In accordance with the present invention, the various parts of the bridge and tailpiece assembly are arranged to enhance the vibrations of the strings.

Various parts of a stringed musical instrument can be selectively configured so as to be free-to-vibrate for augmenting the vibration of the strings, that is, to amplify the energy of the strings. In a preferred embodiment, the free-to-vibrate portions are particularly effective when coupled with the strings or with the bridge elements.

In electric stringed musical instruments, such as electric guitars, the body, which in some instances may not be hollow, does not contribute substantially to the amplification of the instrument. In such instruments, the bridge does not function to transfer the energy of the vibrating string to the body for amplification, rather it reflects the energy back to the string where it is picked up by an electro-magnetic device and amplified electronically. However the use of the bridge for establishing resonances can be most effective when coupling of various free-to-vibrate portions create resonances for reinforcing the vibration of the strings in a manner analogous to the reinforcing effect of a hollow body in a purely acoustic instrument. Since the over-all tonal character of any instrument is effected by the choice of materials, size and shape, and other structural features, the resulting pattern of resonances, its "formant" can be adjusted by these various features to reinforce or modify the sound of the instrument to suit a player's needs.

Free-to-vibrate portions can be a part of the wing-like members on the base plate, a part of the intonation modules mounted on the base plate, part of the structure of the base plate, or other parts connected to the instrument.

The free-to-vibrate portion can be shaped to provide the requisite fundamental resonant frequency. The shape of the free-to-vibrate portion can be a tapered member with the tapering surface being planar or curved. Moreover, weights can be added to the free-to-vibrate portion or mass removed for tuning the fundamental resonant frequency to provide the desired effect. It is also possible, where the free-to-vibrate portion affords its use, to mount a slidable member securable by a set screw on the portion for varying the frequency.

While free-to-vibrate portions can be used for effecting a formant in a stringed musical instrument, such parts can also be employed for controlling the vibration of other objects, such as an automobile engine or even a building or other large structure. In the operation of an automobile engine, or of many other mechanical devices, it is possible for vibrations to develop which have a deleterious effect on the continued operation of the device. By providing the proper free-to-vibrate portions on a vibrating-device, the range of vibrations can be kept within certain limits or tuned for limiting or avoiding damage.

A significant feature of the use of the free-to-vibrate portion is that it is tightly coupled to the vibrating object for achieving the desired result. As pointed out above, the wing-like member forming the free-to-vibrate portion, is formed integrally with the base plate. Without the tightly coupled connection, the influence of the free-to-vibrate portion is not achieved.

Another preferred feature of the invention is the arrangement of the intonation modules on the base plate for providing harmonic and pitch tuning of the individual strings and also for influencing the vibration of the strings by incorporating free-to-vibrate portions as a part of the intonation modules.

The intonation modules are slidably mounted in slots in the base plate for effecting the desired harmonic tuning, that is, for fixing the string length between the first and second critical points. Each intonation module can be separately locked in position establishing the desired length between the critical points.

The second critical point is formed by a bridge element constructed as a part of the intonation module, though it is functionally separate from the rest of the module. The bridge element is connected to a base elongated in the direction of the strings. The base is slidably connected to the base plate and is secured to the base plate after the harmonic tuning is effected. The intonation module base has a front or first end on which the bridge element is formed and it extends away from the bridge element toward the rear end of the body, that is, the opposite end from the neck. The bridge element forms the second critical point. An important feature of the bridge element is its varied curved surface contacted by the string.

A significant feature of the invention is the manner in which the curved surface is formed. In the initial position of the tremolo, the second critical point divides the curved surface into a first section closer to the neck and a second section more remote from the neck. When the base plate is pivoted, the intonation modules and, as a result, the bridge elements pivot with it so that the location of the second critical point changes, increasing or decreasing the tension on the strings. Since the strings each have a different cross-sectional size, there is a variable tensioning effect on the strings. To maintain the fine tuned character of the strings relative to one another, each of the enlarged curved surfaces of the bridge elements are varied relative to one another so that each of the second critical points travels along the surface in differing distances and thereby selectively changing the harmonic tuning. By providing the proper ratio between each of the enlarged curved surfaces on each of the bridge elements, it is possible to compensate for uneven string stretch and maintain the relative harmonic tuning between the strings during the pivoting movement of the tremolo. Furthermore, by increasing the radius of the first section relative to the radius of the second section the upward pitch change can be further augmented. Lastly, by varying the radii continuously a smooth transition from the first section to the second section can be achieved.

Another important feature of the invention is the increased radial size of the bridge elements for maintaining the string height relative to the fingerboard when the tremolo is used. Accordingly, the bridge elements cannot contain rotatable parts, since harmonic tuning would be disturbed in the initial position. Consequently, the bridge elements must be functionally separate from the tailpiece. Further, the strings must slide over the bridge elements during change of tension in the fine tuning.

Another object of the invention compared to the prior art is to provide a shortened spring block or the base plate, moved rearwardly and fitted with smaller string tension biasing springs, so that the whole assembly can be fitted into a single cavity in the body of the instrument below the base plate. This feature simplifies routing of the body.

Still another object of the invention is to provide a stepped base plate and shims for adjusting the height of the bridge elements and for maintaining tight coupling between the bridge elements and the base plate.

Each intonation module has a lever-like tine member pivotally connected to the base adjacent the bridge element, with the tine member extending from the pivot point toward the rear end of the guitar body. A passage is provided through the tine member for receiving the string after it passes over the bridge element, with the string being anchored at the rear end of the passage in the tailpiece part. By pivoting the tine member, the tension on the string can be varied. The pivoting of the lever-like tine member, can be effected by an adjustment member mounted on the base. The tine member has a curved surface extending toward the rear end of the body. The adjustment member can be threaded into the base and into contact with the curved surface and such contact causes the lever-like tine member to pivot about its connection to the base. As a result, the orientation of the passage through the lever-like member can be altered so that the tension of the string passing through it is also changed. Further, the forward tips of the lever-like tine pivot under the bridge element for dramatically increasing the potential of the tension effected by the adjustment member. Accordingly, macro-tuning of the individual strings can be achieved by the adjustment member.

It is also possible to form a rear part of the lever-like member as a free-to-vibrate portion for adding resonances to the bridge and tailpiece assembly. The free-to-vibrate portion of the lever-like tine member can be shaped to provide the desired fundamental resonant frequency. The combination of the free-to-vibrate portions on the base plate and in the intonation modules provide a formant in the instrument.

The base plate is formed of a first part extending generally parallel to the surface of the guitar body and a second part disposed perpendicular to the rear end of the first part and extending downwardly from it into the recess in the body. The second part is connected to spring means within the cavity for effecting the return of the tremolo or bridge assembly into the initial position after the tremolo has been pivoted and released.

The tremolo is pivoted by a tremolo arm secured to one wing-like member of the base plate. An insert is formed in the wing-like member into which the tremolo arm can fit.

To avoid accidental displacement of the tremolo arm, a releasable lock secures it in its initial position until the tremolo arm is to be intentionally pivoted.

Still another significant feature of the invention is the creation of a sophisticated set of tuned resonances in the bridge or the bridge and tailpiece assembly of a stringed musical instrument. In one preferred embodiment, means are provided for creating a formant in the vibration of the guitar as it is played. The desired effect can be achieved by using tapered free-to-vibrate portions tightly coupled to the bridge or bridge and tailpiece assembly. With at least two tapered free-to-vibrate portions each having a broad resonance and a strong central resonance frequency adopting characteristics of a tuning fork, the second harmonic drops from approximately six times the fundamental to within a few Hertz of the fundamental removing any other resonant peaks or dips, other than the third harmonic which relatively is not influential for the bridge mass, since this tuning fork-like apparatus vibrates for an extended period it will keep its secondary resonances created by two cylindrical holes in each tapered free-to-vibrate portion and any other free-to-vibrate portion coupled thereto vibrating and active.

In addition, six other free-to-vibrate portions or tine members are arranged as part of the intonation modules, each tuned to have a broad resonance with its own harmonics or secondary resonances. When secondary resonances from any two or more tine members are placed close to one another harmonically, they simulate the effect of a fundamental broad resonance. By properly tuning the tine members, the tuning fork portions, and their secondary resonances, a formant is established, fully reinforcing the vibrations of any note played on the instrument in a balanced manner and providing exceptional volume, tone and sustain as in great violins.

Since the free-to-vibrate portions are tuned to react with a wide range of frequencies, they act like sensitive antennae vibrating sympathetically to the sound produced by the speakers in the electric amplification means. This increased sensitivity allows for outstanding sustain with lower amplifier distortion at lower playing volumes than would be otherwise possible.

Aluminum alloys are particularly effective in forming the free-to-vibrate portions and afford greater sensitivity than other materials. Stainless steel can also be used for any of the parts of the bridge, or bridge and tailpiece assembly, due to their ability to couple extremely well. Further, stainless steel is relatively free from wear.

Although the invention is described with respect to metal guitar bridges and more specifically fulcrum tremolos, it is equally possible to create free-to-vibrate portions out of wood or synthetic materials such as reinforced graphite, especially for use in purely or semi-acoustic instruments.

Choice of materials in the construction of musical instruments has always been important. As scientific advances and new developments in materials continue to evolve at a brisk rate, their application can be directed to the use of free-to-vibrate portions coupled to musical instruments.

The use of steel, brass and bronze is very common in musical instruments and steel has become the favored material for stringed musical instrument bridges, because of its bright sound, great mass and durability. Accordingly, steel is a suitable material for the present invention, however, for the first time aluminum can be utilized as it shares the same stiffness to mass ratio as steel but will afford a softer sounding, more responsive and resonant response and, depending on the player, may be preferred.

Further, recent advances in ceramics have been outstanding and have produced entire automobile engines. Commercial applications of ceramics are becoming increasingly common in everyday life, for example, reasonably priced bells and knives are available where steel has been replaced by ceramic materials. As ceramics are more readily moldable and offer acoustic properties similar to steel, they can be used for all bridge parts from the intonation module base to the free-to-vibrate portions.

In some applications, particularly those directed toward non-electric or purely acoustic instruments, other materials may be desirable. Certainly, wood is the most obvious choice, throughout history its superior qualities have been demonstrated. Plastics and composites, such as graphite epoxy, have been used successfully to create sound boards for guitars and violins where the mechanical properties of a composite sandwich plate with graphite-epoxy facings and a low density core closely matched those of a conventional spruce plate. Such materials could be used effectively and economically to produce high quality free-to-vibrate resonant plates and bridges of a consistent level.

Another primary object of the present invention is to provide an adjustment device for bringing the strings to pitch at one of several coarse tunings quickly and then fine tuned by separate means.

A tuning adjustment device is provided for securing the string at the head of the instrument and then making a fine tuning adjustment by means of a thumb screw. The tuning device is pivoted on the head end of the stringed instrument and is movable between several tensioned positions and a untensioned or released position. In the tension position the anchorage for the string is located relatively close to the nut at the head end of the instrument so that little bending of the string takes place.

The tuning device is formed as a two armed L-shaped lever pivotally mounted on a bracket secured to the head end of the instrument in the region of the nut. The string is secured at a free end of one arm of the lever and a locking means for the device is provided adjacent the free end of the other lever arm. The locking means is in the form of a forceps-like clamp containing a plurality of teeth so that each tooth provides a different locking position. By changing the locking position the tension on the string can be quickly increased or decreased as required for providing preset pitch changes.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWINGS

In the drawings:

FIG. 9A is a side view of an engine with an attached free-to-vibrate section;

FIG. 9B is a view of a building frame with a free-to-vibrate portion;

FIG. 9C is an enlarged detail view of the encircled part in FIG. 9C;

DETAILED DESCRIPTION OF THE INVENTION

Figure 1:
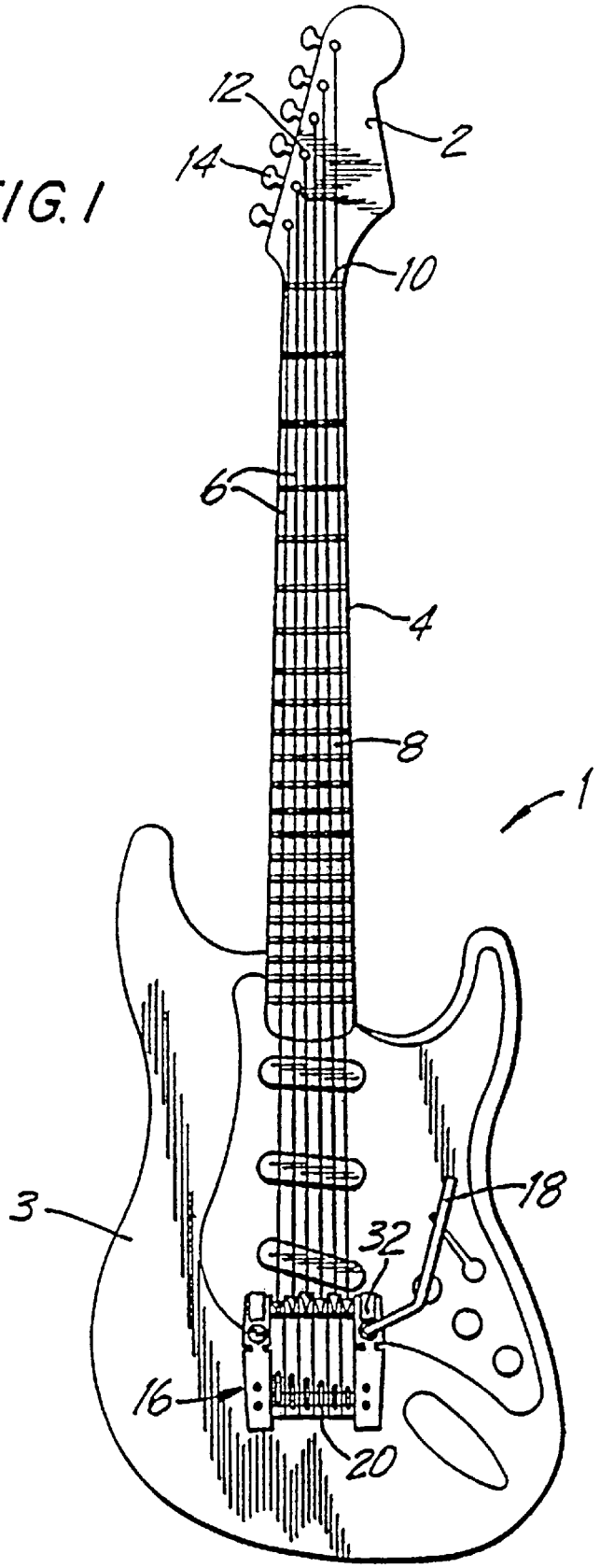
FIG. 1 is a plan view of an electric guitar embodying the present invention.

In FIG. 1, an electric guitar 1 is illustrated comprising a head 2 at one end, a body 3 at the other end, with a neck 4 extending between the head and the body. Six strings 6 extend from the head 2 to the body 3 over the neck 4. The neck 4 forms a fret board 8 for the guitar. At the head, each of the strings extends over a nut 10 forming the first critical point for the strings. The nut 10 is located at the transition from the neck 4 to the head 2. Each of the strings 6 is anchored on the head by an anchor 12 and each anchor has a corresponding tuner or tuning peg 14. On the body 3, the strings 6 are secured to a bridge-tailpiece assembly 16. The bridge-tailpiece assembly is a fulcrum tremolo with an arm 18 for pivoting the fulcrum tremolo and providing a vibrato effect on the strings. The bridge-tailpiece assembly 16 includes six intonation modules 20.

In the body 3 of the guitar there are electric pick-ups.

In the following description, the bridge-tailpiece assembly 16 will be described in greater detail.

The bridge-tailpiece assembly 16 forms a second critical point for the strings 6, sometimes characterized as an intonation point or bridge point.

Figure 2:
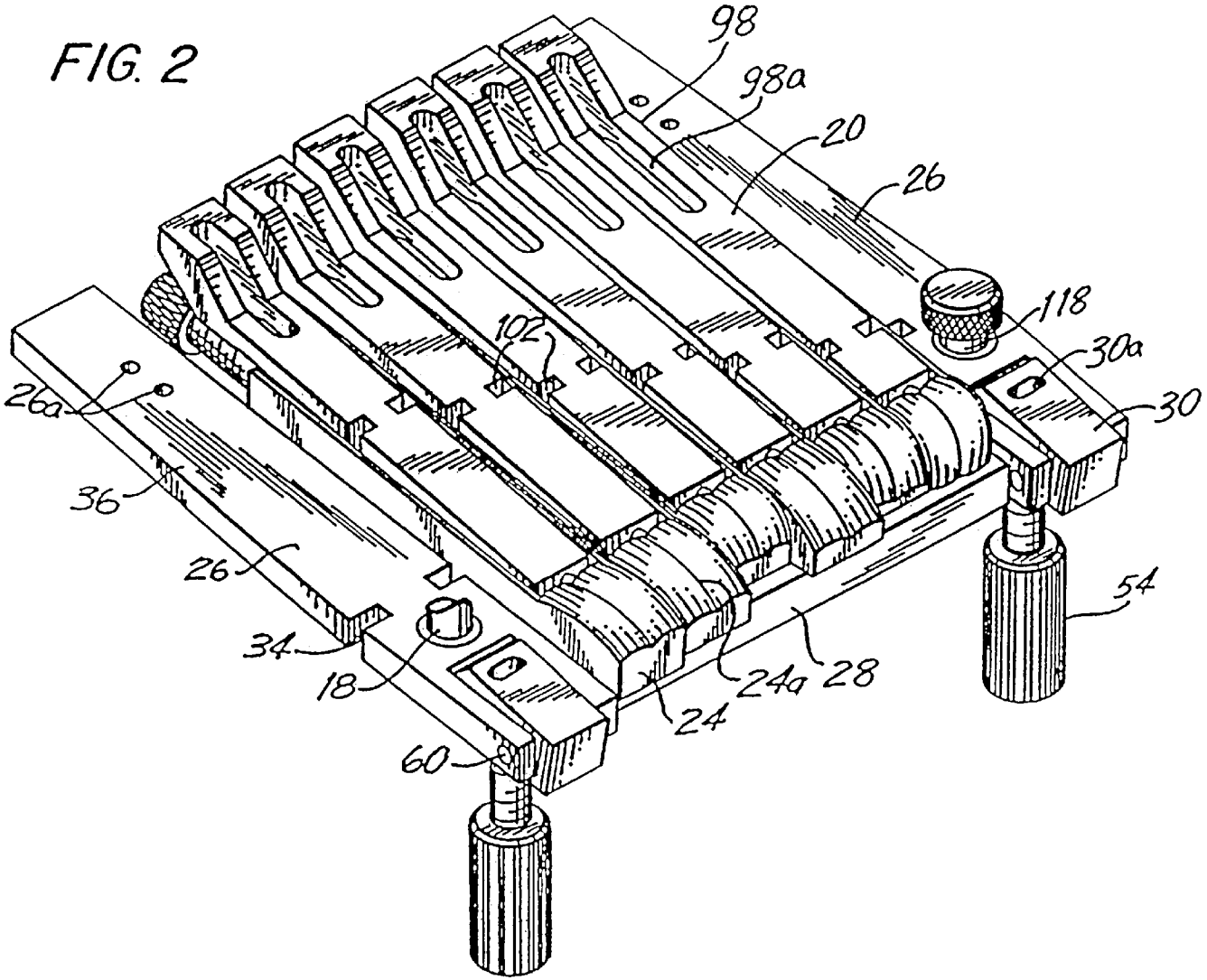
FIG. 2 is a perspective view of a tremolo-bridge-tailpiece assembly as used in the guitar of FIG. 1.
Figure 3:
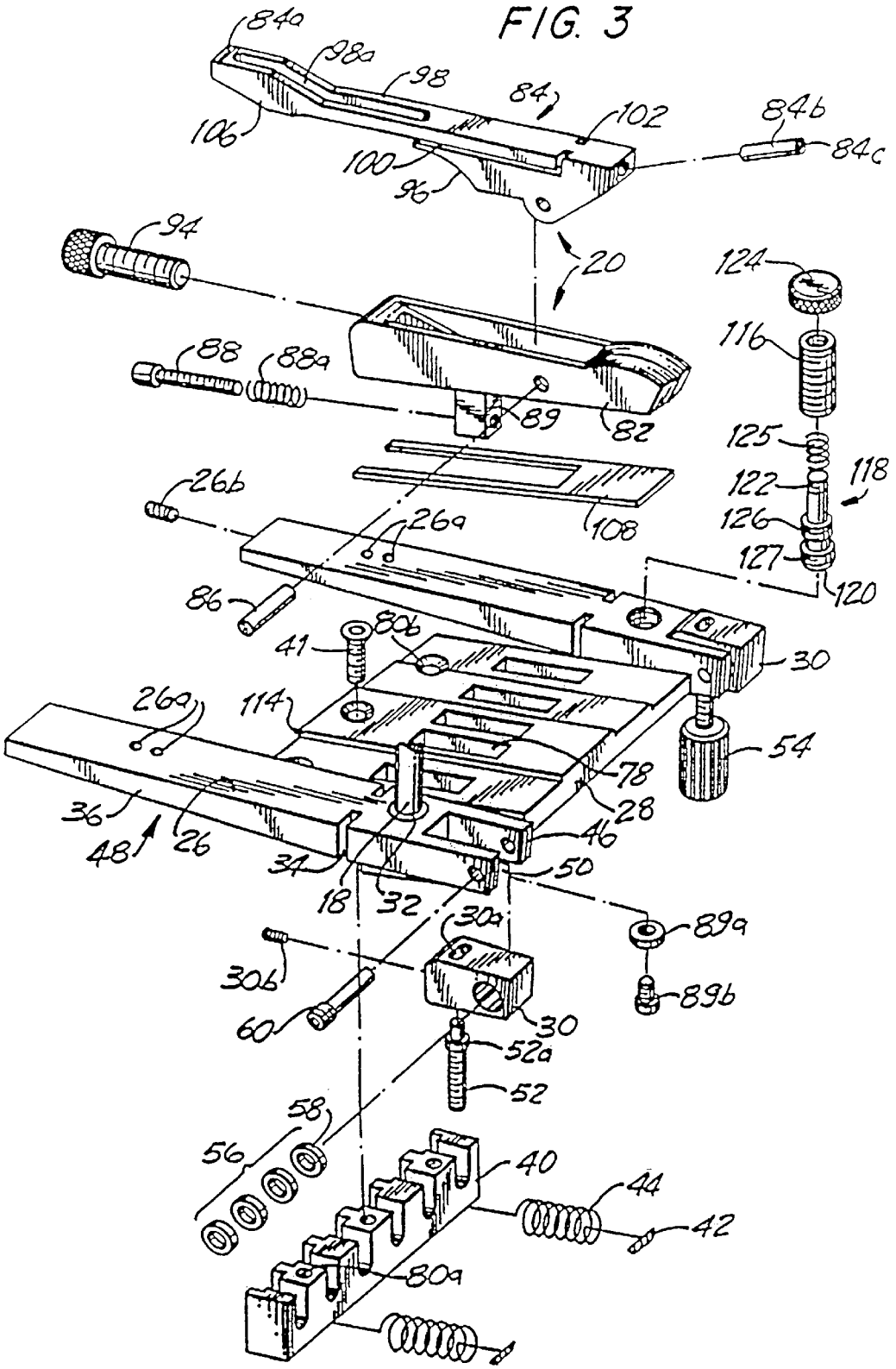
FIG. 3 is an exploded perspective view of the tremolo-bridge-tailpiece assembly in FIG. 2.
Figure 4B:
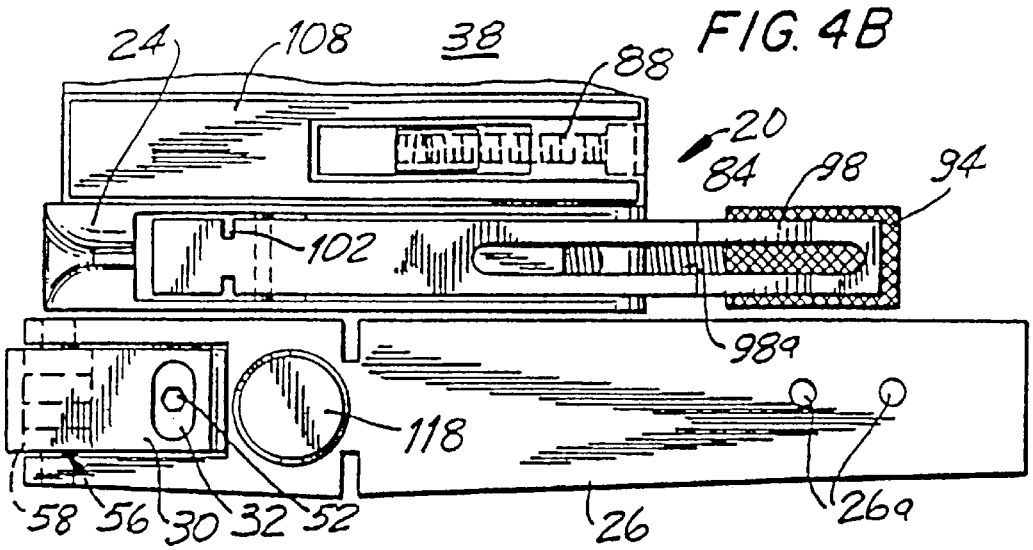
FIG. 4B is a partial plan view of the bridge-tailpiece assembly of FIG. 3A.
Figure 4A:
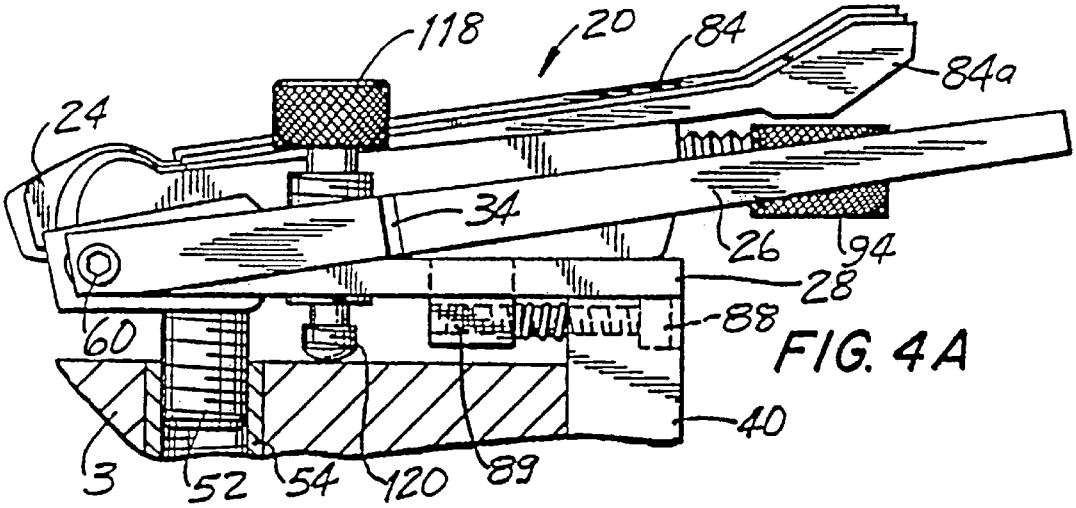
FIG. 4A is a side view of the bridge-tailpiece assembly of FIG. 2.
Figure 4C:
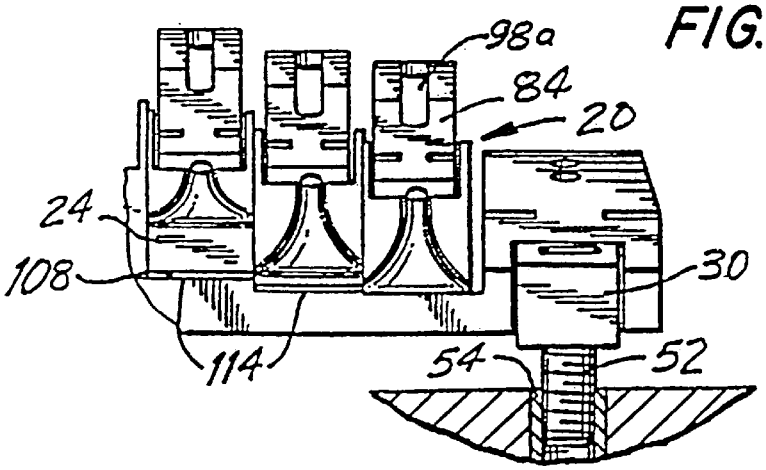
FIG. 4C is a partial end view of the bridge-tailpiece assembly of FIG. 3A.

In FIG. 2, the bridge-tailpiece assembly 16 or fulcrum tremolo is shown on an enlarged scale as compared to FIG. 1. FIG. 3 displays the bridge-tailpiece assembly 16 of FIG. 2 in an exploded view. The second critical point is located at the front end of the assembly 16 extending across the bridge elements 24. There is a separate bridge element 24 for each of the intonation modules 20. Outwardly from the intonation modules 20 on each side of the opposite sides extending in the string direction, there are two wing elements 26. The wing elements 26 are formed integrally with a main stepped plate 28. Each of the wing elements 26 is supported on a bearing housing 30. The bearing housings 30 pivotally support the stepped base bridge plate 28. The tremolo arm 18, shown only in part, is secured within an arm insert 32 and pivots the assembly 16 relative to the bearing housings 30.

Each wing element 26 is secured integrally with the main bridge plate 28 in the region of the bearing housing 30 and the arm insert 32. Immediately behind the arm insert 32 are slits 34 extending transversely of the long direction of the wing elements, that is, transversely of the direction of the strings 6, and partially separating a free-to-vibrate portion 36, from the portion of the wing element 26 secured to the stepped base plate 28.

As can be seen in FIG. 9, the body 3 has a routed opening 38 located below the bridge-tailpiece assembly 16, with a spring block 40 secured by bolts 41 to the stepped base plate 28 and extending downwardly from it, into the routed opening 38. A spring plate 42, shown only schematically, is secured within the routed opening 38 below the stepped base plate and spaced slightly rearwardly from the bridge elements 24. Springs 44 extend between the spring plate 42 and the spring block 40 for returning the bridge-tailpiece assembly 16 back to its original position, after it has been pivoted by the tremolo arm 18.

The wing elements 26 extend generally parallel with the intonation modules 20 and with the strings 6. Each wing element 26 is pivotally supported by its bearing housing 30. The forward portion 46 of the wing element 26, located closer to the neck 4, is formed integrally with the stepped base plate 28.

The forward portion 46 of the wing element 26 is fairly massive, while the rearward portion 48 tapers from the forward portion, separated partly from it by slits 34, into a relatively thin section forming the free-to-vibrate portion 36. Transverse to the string direction, the wing elements 26 are relatively wide, being somewhat wider than the intonation modules 20. The rearward portion 48 or free-to-vibrate portion 36 is separated from the stepped base plate 28.

The free-to-vibrate portion 36 is shaped to provide the desired resonance for enhancing the vibration of the strings and improving the tone of the guitar. The free-to-vibrate portion 36 can have curved or tapered surfaces. In addition to the shape of the free-to-vibrate portion, the desired resonance characteristic can be achieved by drilling single or multiple holes **26*a* in the portion, and by adding mass to or removing mass from the portion 36. The holes 26*a* can be joined together to form elongated slots intermediate the ends of the free-to-vibrate portion or extending from the free end toward the coupled end. In FIG. 3 a set screw 26*b*** is inserted into a threaded hole, not shown, for fine tuning the pitch of the free-to-vibrate portion.

In FIGS. 2, 3 and 4A–4C, the bearing housing 30 is shown at the forward end of the wing element 26. The bearing housing 30 fits into a cut-out 50 in the forward end of the wing element 26. The housing 30 is adjustably supported relative to the body 3 of the guitar by a threaded post 52 with annular flange **52*a*. Post 52 is threaded into a housing insert 54 in the body 3 of the guitar, note FIGS. 4A and 4C. By adjusting the extent of the threaded engagement for the post 52 into the body insert 54, the spacing between the body 30 and the surface of the body 3 is selectively adjustable. Adjustment of the post 52 is effected through an oval opening 30***a* in the top of the housing 30. The oval shape permits relative movement between the post 52 and the housing 30. A set screw 30*b* fits into the rear end of the housing 30 to secure the post 52. In the housing 30, forwardly of the post 52, there is an opening through the housing extending transversely of the string direction of the guitar containing a quad-stack bearing assembly 56, formed by four side-by-side roller bearings 58. A pin or shaft 60 is threaded into one side of the wing element 26 and extends through the bearings 58 into the wing element on the opposite side of the recess 50. Accordingly, by manipulating the tremolo arm 18, the bridge-tailpiece assembly 16 or fulcrum tremolo can be pivoted about the pin 60 to achieve the desired effect when playing the guitar.

While a quad-stack bearing assembly 56 is shown for pivotally supporting the bridge-tailpiece assembly 16, a variety of pivot bearings could be employed. A significant feature is that the bearing assembly permits the displacement of the bridge-tailpiece assembly with the pivot axes of the pins 60 not parallel to the surface of the body 3. This feature is important when the bearing housings 30 on the opposite sides of the bridge-tailpiece assembly each have a different height above the body surface of the guitar.

As shown in FIG. 3, the sleeve-like arm insert 32 is threadably secured in the forward portion 46 of the wing element. The arm 18 is threadably secured in the insert. By means of the arm, the bridge tailpiece assembly 16 is pivoted.

In FIG. 3, the stepped base plate 28 is shown with the attached wing elements 26. Note that the free-to-vibrate portions 36 are separate from the main bridge plate and are partially separated from the forward portion 46 by the slits 34. The main bridge plate 28 includes the spring block 40 located at the rearward end of the plate, that is, the end more remote from the neck of the guitar.

Approximately in line transversely of the string direction with the insert 32, are six rectangular openings 78, note FIG. 3. Each of these openings receives a portion 89 of each of the intonation modules 20 to be described later.

In FIG. 3, a portion of the tremolo arm 18 is shown extending upwardly from the insert 32 for effecting the pivoting action of the bridge-tailpiece assembly 16. The spring block 40 is provided with screw holes 80*a* aligned with screw holes 80*b* in the base plate 28 to receive bolts 41 for securing the block to the plate. The springs 44 are secured to and extend between the spring plate 42 and the spring block 40. The springs 44 return the bridge-tailpiece assembly 16 to its original position after the tremolo arm 18 is released following pivotal displacement of the assembly.

In FIG. 3, one of the intonation modules 20 is shown, including a base 82 with a bridge element 24 located on the right hand end of the base. A lever member 84 is pivoted to the base by a pivot pin 86. The base 82 is adjustably secured to the spring block 40 of base plate 28 of the bridge-tailpiece assembly 16 by a bolt 88 and spring 88*a*. The bolt 88 is supported in the spring block 40 and is threaded into a projection 89 on the base 82 extending through an opening Spring 88*a* encircles the bolt 88 between the block 40 and the projection 89. By turning the bolt 88 the position of the intonation module relative to the base plate 28 can be adjusted. As can be seen in FIG. 2, the openings 78 are elongated in the string direction and permit adjustment of the intonation module in that direction for effecting harmonic tuning. The positions of individual intonation modules can be adjusted by turning the bolts 88. The projecting 89 is secured at the under side of the base plate 28 by a washer 89*a* and a bolt 89*b* threadably secured and into the underside the base 82.

The bridge element 24 has a recessed variably curved portion 24*a*, note FIG. 3, in which the corresponding string 6 seats as it moves over the bridge element. From its point of contact with the bridge element 24, that is, at the second critical point, the string 6 moves downwardly into an elongated passageway 90 extending first through lever member 84 and then through the base 82 from adjacent and just rearwardly of the bridge element 24 to the rearward end of the base, note FIGS. 5A and 5B. At the front end of the lever member 84, at the entrance into the passageway 90 there is a stainless steel sleeve 84*b* which forms a wear resistant surface for the strings 6. At the rearward end of the passageway 90, an enlarged recess 91 in the base 82 is provided for an anchor 92 securing the ball end of the string 6.

Figure 5A:
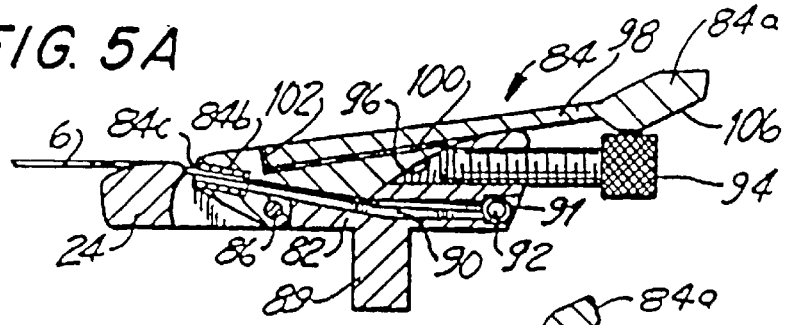
FIGS. 5A and 5B are side views illustrating the range of displacement of a lever member in the intonation module.

An adjustment screw 94 is threaded into the rearward end of the base 82 into engagement with a surface 96 of the lever member 84. In FIG. 5A, the adjustment screw 94 contacts the surface 96 so that the string 6 is in contact with the surface 96 at its intersection with the passageway 90. This position is the rearwardmost point of contact of the string within the passageway 90 with the lever member 84.

Figure 5B:
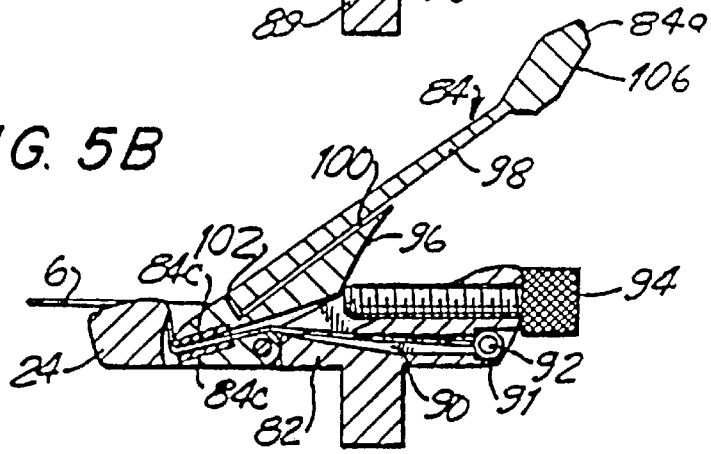

In FIG. 5B, the maximum range of upward displacement of the lever member 84 is shown. As the lever member 84 is pivoted upwardly by threading the adjustment screw 94 forwardly into the base 82, the sleeve 84*b* in the forward end of the passageway 90, that is, the forward end of the lever member 84, contacts the string 6 and presses it downwardly providing an adjustment in the pitch tuning of the string by varying the tension or pull exerted on the string. The contact of the string 6 with the surface of the corresponding bridge element 24 is also varied. As the adjustment screw 94 is moved between the two limiting positions, shown in FIGS. 5A and 5B, the tension on the string 6 is varied.

The lever member 84 has a free-to-vibrate portion 98 formed by a slit 100 in the lever member extending in the string direction from a rearward part of the surface 96 to a point approximately above the pivot pin 86. Slits 102 extending transversely of the slit 100 pass through the lever member connecting the slit 100 with the upper surface of the lever member. The slits 102 can be seen in FIGS. 2, 3, 5A and 5B. The free-to-vibrate section 98 of the lever member 84 extends from the slits 102 to the rearward end of the lever member 84 where the free end 84*a* is enlarged to form a mass 106 for obtaining the desired resonance effect for the lever member. Slots 98*a* can be formed in the broad surface of the free-to-vibrate section 98 of the lever member 84 for achieving the desired resonance effect.

While only a single intonation module is illustrated in FIGS. 3, 5A and 5B, the lever members 84 for each of the intonation modules can be selectively shaped to afford the desired resonance effect for the whole bridge tailpiece assembly. The combination of the resonance effects of the lever members 84 added to the resonance effects of the tuning fork-like tapered wing elements 26 provides a fornant for the guitar not previously attainable.

In the bridge-tailpiece assembly 16, the tailpiece afforded by the rearward end of the base 82 of each intonation module 20 is functionally separated from the bridge element 24 located on the forward end of the corresponding intonation module.

In the past, any adjustment available in the bridge-tailpiece assembly has been limited to fine tuning, usually less than a range of three pitches where the octave has twelve pitches. With the adjustment screws 94 of each intonation module 20, it is possible to obtain macro tuning where the range extends over a full octave creating a means to bring from an untensioned condition of the string to proper playing pitch. With this arrangement, it is possible to eliminate the tuning pegs at the opposite end of the guitar and provide what has been characterized as a "headless" guitar. With the range of displacement of the lever member 84, by contact between the adjustment screw 94 and the curved surface 96 of the lever member, the range of macro tuning can be finely varied like conventional tuning pegs at the head of an instrument.

Accordingly, the intonation modules provide an increased range of tuning, not previously available, and, in combination with the free-to-vibrate portions 98, formed by the individual lever-like free-to-vibrate portions, the resonant characteristics of the guitar can be improved to achieve the resonant characteristics of a violin.

In FIGS. 6A–6F, bridge elements 24A–24F for each of the individual modules are illustrated. The six strings 6, each associated with a different one of bridge elements 24 are, starting from the top, E, B, G, D, A and E strings. Though not shown, each of the strings has a different make-up or structure, if a single string is used, the strings have different diameters and, if the strings have a core wire wrapped with a helical wire, the diameter of the strings are different. With different diameters and wire characteristics, the change or elongation of each wire, when it is stretched, is also different. Accordingly, the individual bridge elements 24A–24F are each shaped differently to accommodate the particular string extending over the bridge element having an enlarged curved surface as compared to the prior art.

Each bridge element 24A–F has a surface contacted by the string with different large continuously variable radii. First radii extend from the initial second critical point toward the neck of the guitar and the second radii extends from the initial critical point in the opposite direction. The first radius for each of the bridge elements is twice the second radius.

Establishing the radii of the bridge element 24F as a standard of 1:1, the bridge element 24E has radii as compared to the bridge element 24F in the ratio of 1.25:1. In turn, the bridge elements 24D, 24C, 24B and 24A have radii ratios as compared to the bridge element 24F, as follows:

2.40:1, 1.20:1, 2.46:1 and 4.01:1.

As a result, when the fulcrum tremolo or the bridge-tailpiece assembly is pivoted, the tuned characteristics of the strings relative to one another remain the same.

Figure 6A:
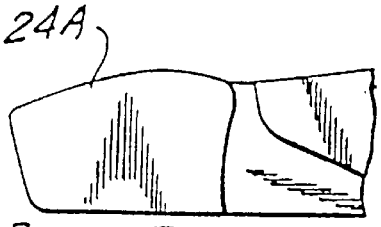
FIGS. 6A, B, C, D, E and F are cross-sectional views of the different bridge elements mounted on the intonation modules as shown in FIG. 1 and FIG. 2.
Figure 6B:
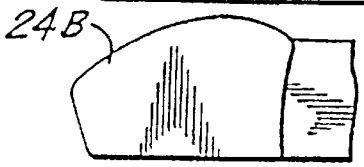
FIGS. 6G and 6H are schematic illustrations of a bridge element showing the prior art.
FIGS. 6I and 6J are schematic illustrations of the bridge elements of the present invention.
Figure 6C:
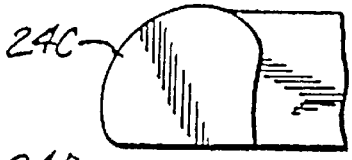
Figure 6D:
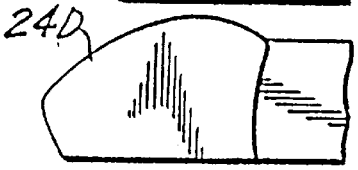
Figure 6E:
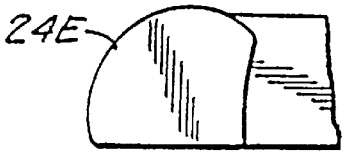
Figure 6F:
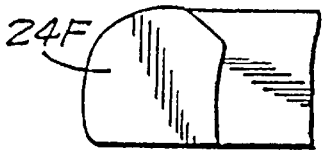
Figure 6G:
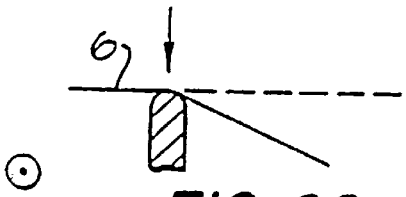
FIG. 6G PRIOR ART
Figure 6H:
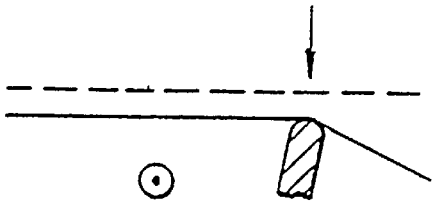
FIG. 6H PRIOR ART
Figure 6I:
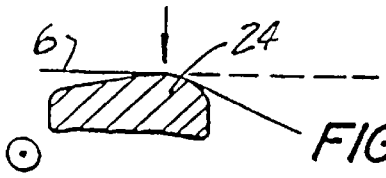
Figure 6J:
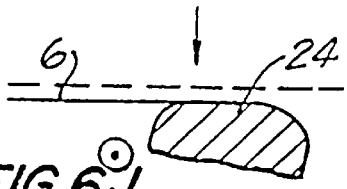

In FIGS. 6G and 6H the prior art arrangement is shown, while FIGS. 6I and 6J illustrate the present invention. FIGS. 6G and 6I display the initial position of the second critical point, and FIGS. 6H and 6J exhibit a pivoted position. The fulcrum pivot point is shown to the left of the bridge element by a dot within a circle. In FIG. 6H the fulcrum tremolo is pivoted to increase string tension and the second critical point and string height drop. The second critical point moves away from the first critical point.

In FIGS. 6I and 6J it can be noted that the bridge element has an enlarged curved surface relative to the bridge element in FIGS. 6G and 6H. Further the bridge element surface of the present invention has a continuously varied radius. As set forth in FIG. 6J, when pivoted the bridge element and the second critical point drop for a lesser amount than in FIG. 6H, the prior art. Moveover, the second critical point moves over the bridge element surface toward the first critical point. Accordingly, the pivoting effect is augmented and with continuously variable enlarged curved surfaces corresponding to the stretch characteristics of the strings, it is possible to maintain relative harmonic tuning between the strings.

The continuously varying curved surfaces afford a smooth transition from the sections on opposite sides of the initial second critical point position.

Depending on the strings a single radius can be provided on the opposite sides of the initial second critical point position.

In providing relatively large variable radii for the bridge elements 24A–F, a previous problem, that develops in pivoting the assembly downwardly toward the neck 4, where the strings may contact the surface of the neck or fret board 8, causing the strings to lose their tuned characteristics, is avoided. A stepped base plate 28 provides means for raising the intonation modules upwardly to match the curved surface of the transverse cross-section of the fret board. Additionally, shims 108, in combination with the stepped base plate 28, compensate for differing curvatures of the fret board from instrument to instrument from model to model. The shims 108 each have an elongated slot 110. The slot permits the shim to be placed between the base plate 28 and the base 82 of the intonation module and to be slid past the downwardly extended block 89 of the base which extends through the opening 78. By releasing the bolt 89*b*, the shim can be inserted and then secured in place by tightening the bolt.

The stepped base plate 28 is shown with the steps 114 affording increases in height from the outside toward the center of the base plate. If necessary, the combination of the shims 108 and the steps 114 in the base plate 28 can be used to achieve the desired height of the strings above the neck.

Figure 7A:
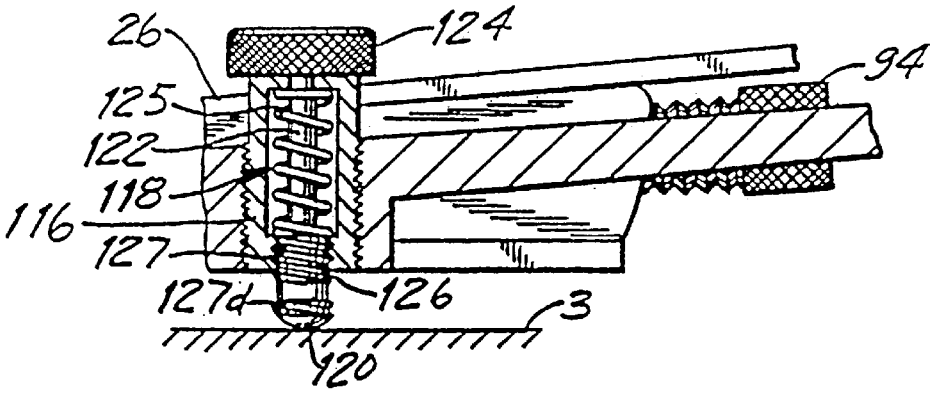
FIG. 7A is a side view, partly in section, of a retractable tremolo limiter in a limiting position.
Figure 7B:
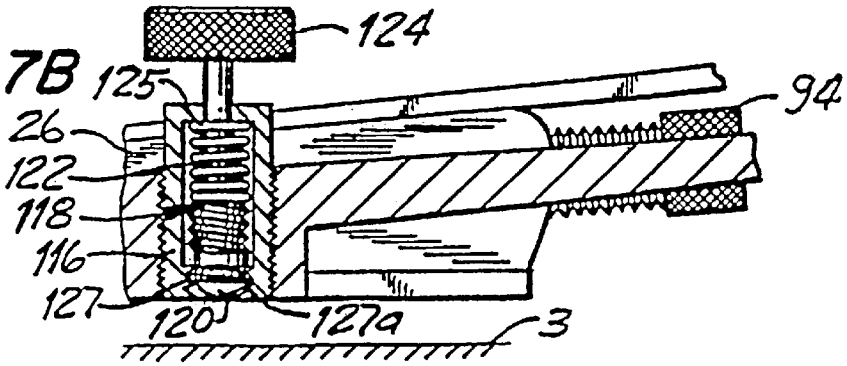
FIG. 7B is a side view, similar to FIG. 7A, however, showing the tremolo free to pivot.

When the electric guitar 1 is being played, it may be desirable to prevent any accidental pivotal movement of the tremolo arm. While a variety of different tremolo arm locks or limiters can be used, one embodiment is disclosed in FIGS. 9A and 7B. In FIGS. 2, 7A and 7B, a tremolo limiter insert 116 is threaded into the wing element 26. A limiter pin 118 is inserted into the insert 116. The limiter pin 118 has a head 120 arranged to contact the guitar body, a shank 122 extending through the insert, and a knob 124 on the opposite end of the shank from the head. A compression spring 125 is located between the end of the head 120 connected to the shank 122 and the upper end of the insert 116 through which the shank passes. A thread 126 is formed on the head in engagement with a corresponding thread 127 on the inner surface of the insert. The lower end of the head as viewed in FIGS. 7A and 7B is rounded for providing a limited contact area with the guitar body.

In the position shown in FIG. 7A, the head is in threaded engagement with the insert so that it remains in position preventing the tremolo arm from pivoting so that the bridge-tailpiece assembly cannot pivot.

If the threaded engagement between the head 120 and the insert 116 is released, as shown in FIG. 7B, the head is retracted into the insert 116 and the tremolo arm 118 and bridge-tailpiece assembly can be pivoted, as desired. An additional thread 127*a* is located on the head 120 adjacent its free end for holding it in the retracted position, shown in FIG. 7B.

The spring 125 biases the limiter pin 118 toward the body 3 of the guitar.

In addition to the means for varying the resonance or pitch afforded by the lever-like members of the intonation modules and the wing elements, a set screw, not shown, can be inserted into the free end of the lever member 84. By varying the depth or position of these set screws within the wing elements and the lever members, a fine tuning of the pitch of the element or member can be achieved.

Figure 8A:
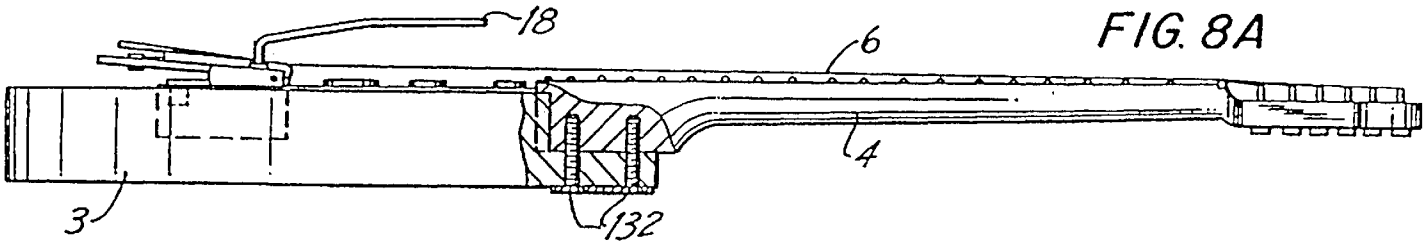
FIG. 8A is a partial side view of a guitar with a "bolt-on" neck.
Figure 8B:
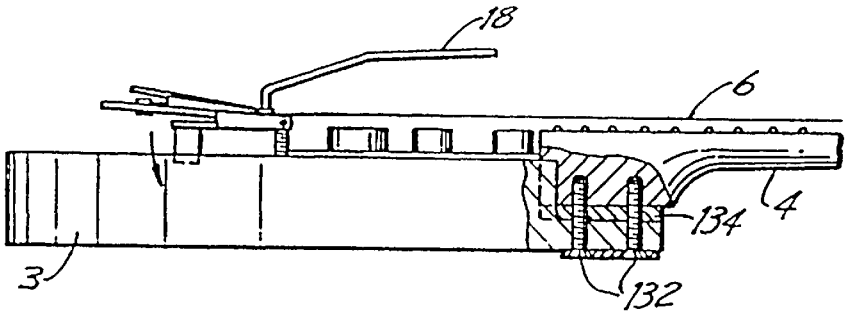
FIG. 8B is a view similar to FIG. 8A with a flat shim.
Figure 8C:
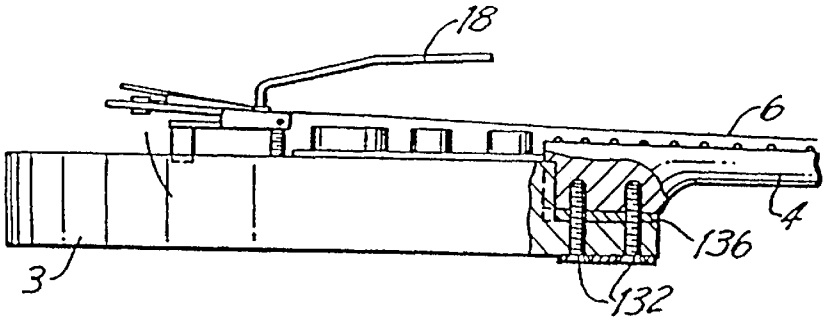
FIG. 8C is a view similar to FIG. 8B with a wedge shim.

In guitars with a "bolt-on" neck design, the neck 4 and body 3 of the guitar are secured together, as shown in FIG. 8A, note the bolts 132 securing the body and neck together. To raise the string height from the instrument body at the bridge-tailpiece assembly, the flat shim 134 of FIG. 8B or the wedge shim 136 of FIG. 8C can be used. As a result, a greater area of the movement is afforded the fulcrum tremolo's upward pitch change for the guitar strings is obtainable and provides for a tighter coupling between the neck and the body.

As mentioned above, a properly adjusted free-to-vibrate portion can be used in a variety of ways to control vibration in different apparatus.

In FIG. 9A, an engine 140 is illustrated with a free-to-vibrate portion 142 tightly coupled to it for equalizing frequency response. The free-to-vibrate portion has holes 142*a* drilled into it to provide the desired resonant character for preventing the development of vibration which would tend to deteriorate the quality of the sound provided by the microphone or speaker.

FIG. 9B shows a building frame 240A with a free-to-vibrate portion 242 tightly coupled to it. The free-to-vibrate portion 242 is connected to a part of the structural frame, such as a beam or column.

The free-to-vibrate portion, as shown in FIGS. 9A–C, could be used in a variety of different mechanisms or vehicles to prevent the development of undesired vibrations. For instance, the free-to-vibrate portions or tines could be connected to the frame of a helicopter or airplane to control vibration. Such free-to-vibrate portions could be used in bridge structures to control harmonic vibrations. Moreover, the free-to-vibrate portions or tines could be employed in combustion engines, electric motors, plumbing, elevator structures, cam shafts, and other structures subject to harmful vibrations.

The foregoing description has been directed to an electric guitar, however, the basic concept described above with regard to vibration or resonance control can also be achieved in an acoustic guitar.

Figures 1, 10B:
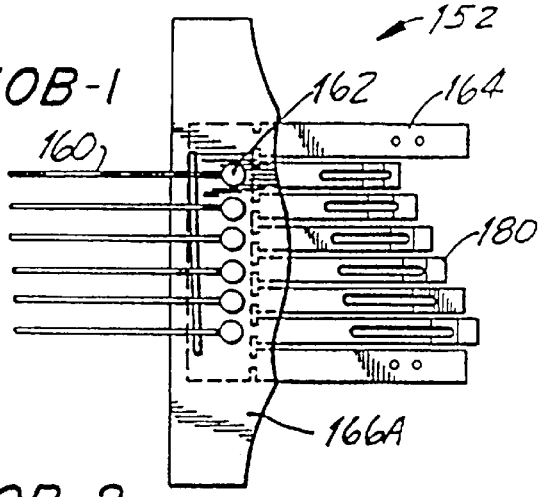
FIG. 10B is an enlarged partial plan view of the acoustic guitar and resonance bridge.
Figures 2, 10B:
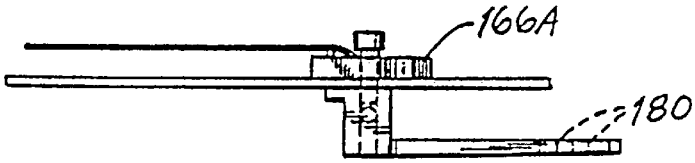
Figures 3, 10B:
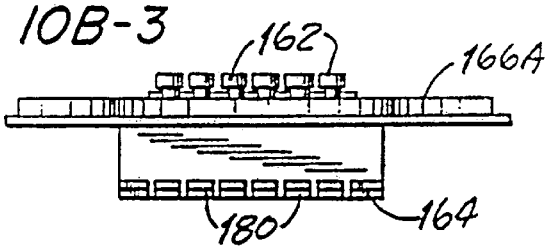
Figure 10A:
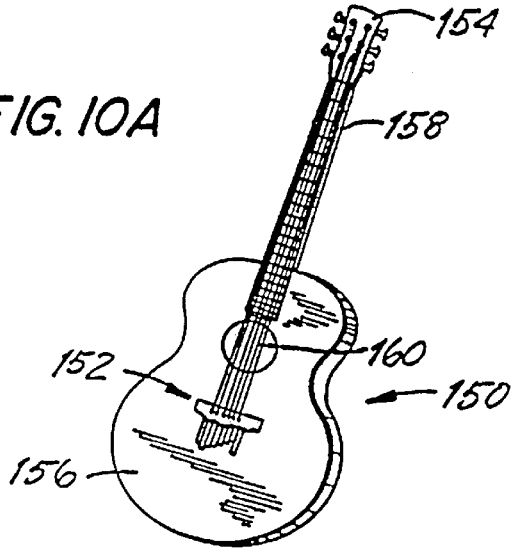
FIG. 10A is a perspective view of an acoustic guitar with a resonance bridge.

In FIG. 10A, an acoustic guitar 150 is shown with a resonance bridge-tailpiece 152. The guitar has a head 154, a body 156, and a neck 158 extending between the body and the head. Strings 160 extend between the head 154 and the bridge 152.

In FIG. 10B, a different arrangement of the acoustic guitar is depicted with a resonance bridge, to which the strings are connected, located within the body 156 and with the strings 160 secured to the bridge at anchors 162. In FIG. 10B, free-to-vibrate portions of the wing elements 164 are located laterally outwardly from the strings 160. The portions 164 are shaped or drilled to provide the desired resonance effect, note the holes shown toward the free ends of portions 164. Other free-to-vibrate portions 180 are aligned with the strings 160.

Figures 1, 10C:
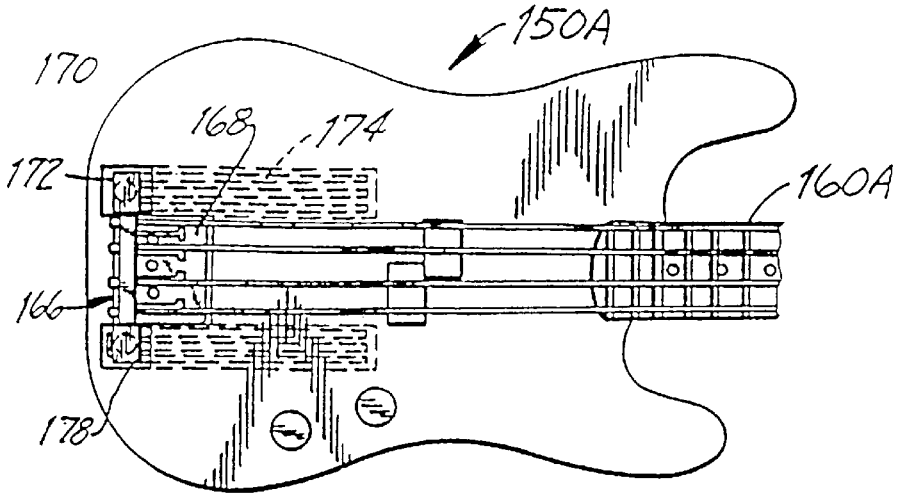
FIG. 10C is a side view of the acoustic guitar and resonance plate.
Figures 2, 10C:
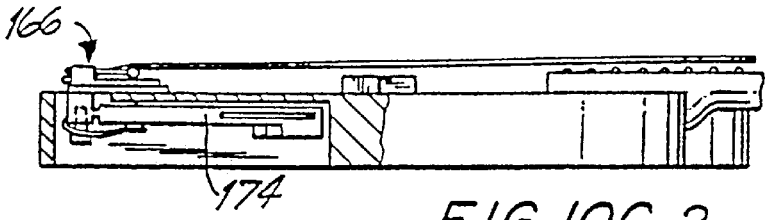
Figures 1, 10D:
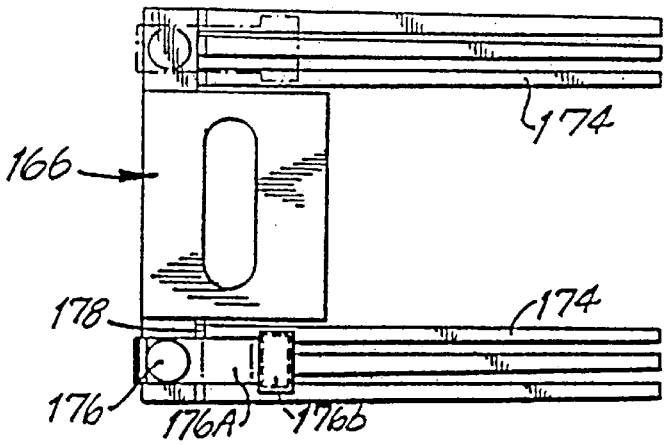
FIG. 10D is a plan view of the resonance plate separate from the bridge.
Figures 2, 10D:
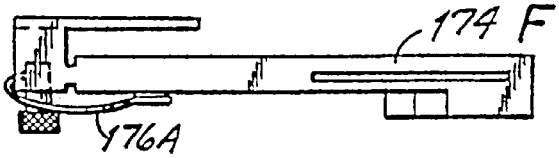
Figures 3, 10D:
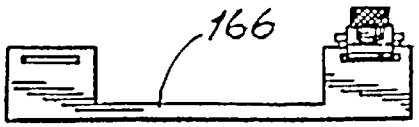

In FIGS. 10C an electric bass guitar 150A is illustrated with four strings 160A. It includes a resonance plate 166 coupled to but separate from an existing bridge-tailpiece 168. The existing bridge-tailpiece 168 fits onto the base 170 of the plate 172 with free-to-vibrate portions 174 located laterally outwardly from the bridge 168. An adjustment member with an adjustment screw 176, a spring steel arm 176*a* and a felt pad 176B is located at a coupled end 178 of each of the groups of three free-to-vibrate portions 174 on the opposite sides of the strings. By adjusting the screw 176, the spring steel arm 176*a* provides a variably tension pressing the felt pad 176*b* against the free-to-vibrate portions 174 for controlling the degree of vibration, whereby the desired resonance of the free-to-vibrate sections 174 can be achieved. This arrangement provides a mute assembly for the free-to-vibrate portion of the resonance plate.

In FIG. 10B, a one-piece construction is shown of the acoustic guitar bridge-tailpiece with a resonance plate 166A. The combined bridge and resonance plate is secured to the body of the guitar. The resonance plate 166A has two wing elements 164 spaced apart by six differently shaped free-to-vibrate sections 180. Each of the wing elements 164 and the free-to-vibrate sections 180 are drilled or provided with elongated slots to obtain the desired resonance effect. On the combined bridge and resonance plate, the individual strings are anchored each in alignment with a different one of the free-to-vibrate sections 180. Each string 160 is secured to a separate anchor 162.

FIGS. 11A–11D display a device for tuning or tensioning a string in a stringed musical instrument.

Figure 11A:
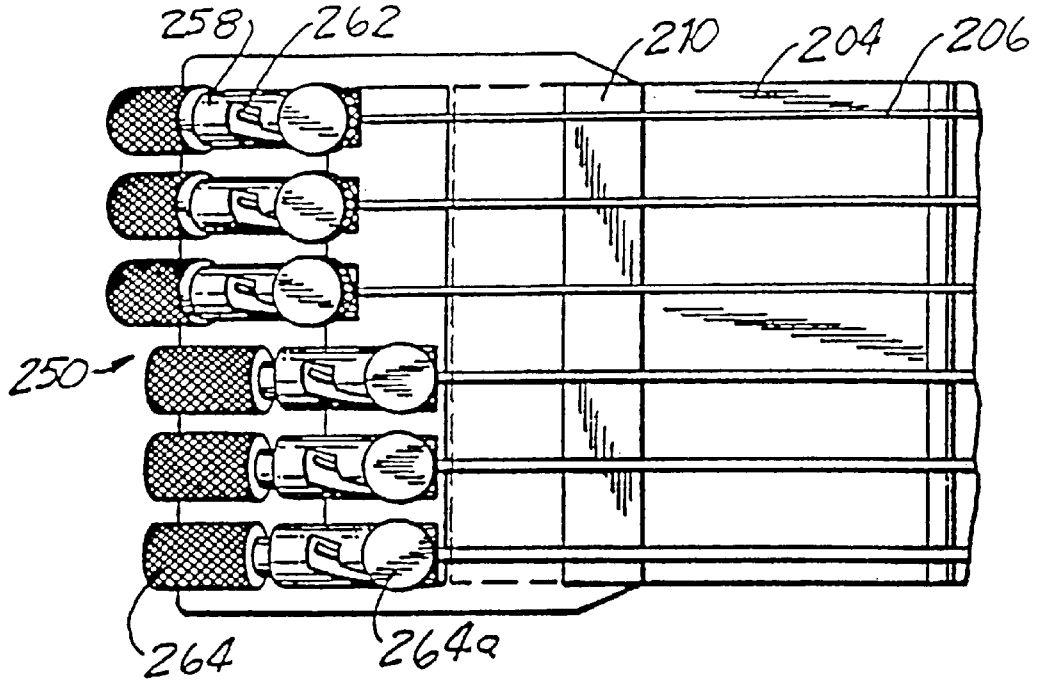
FIG. 11A is a plan view of a plurality of adjustment tuning devices for use on a stringed instrument.

In FIG. 11A, the end of an instrument neck 204 is shown with six strings 206 all of a different size. The strings pass over a nut 210 and each string is secured by a string tensioning or tuning device 250. There is a separate device 250 for each of the six strings. Each device 250 is similar.

Figure 11B:
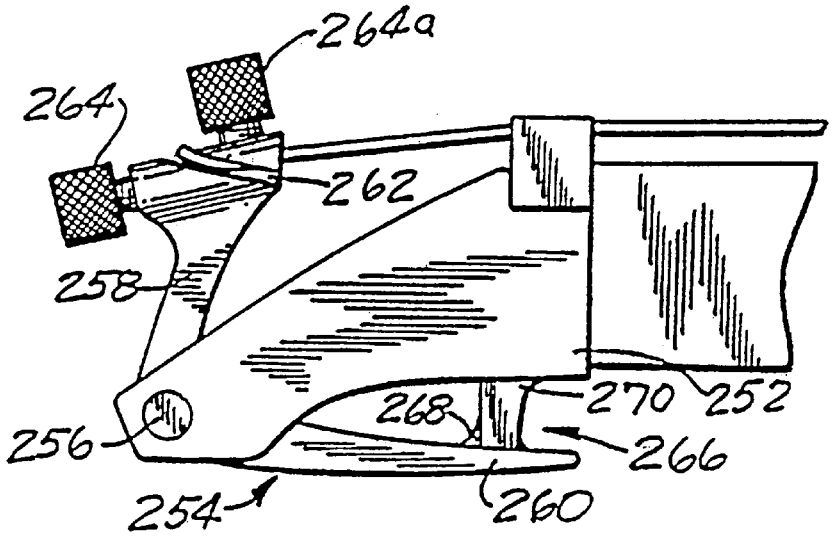
FIG. 11B is a side view of one of the devices shown with the string in the tensioned position.
Figure 11C:
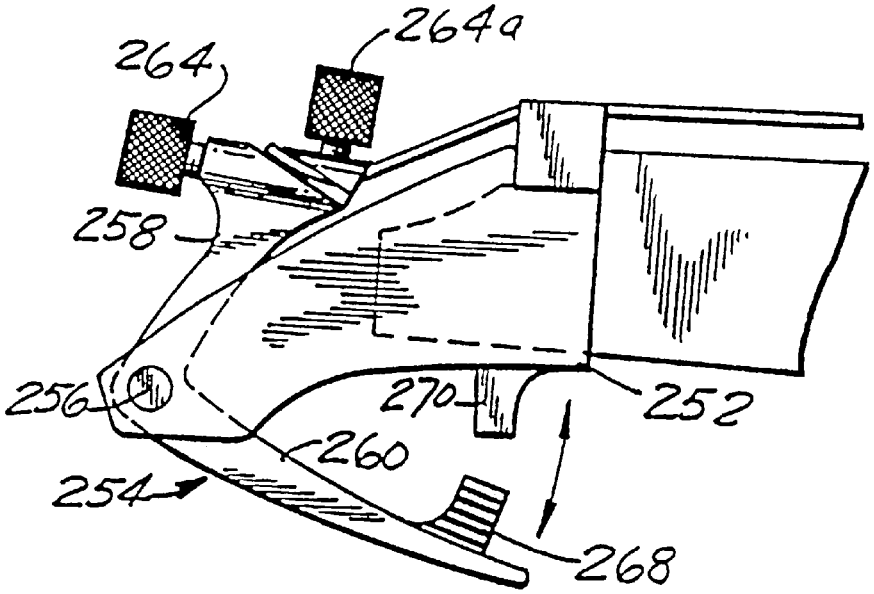
FIG. 11C is a side view, similar to FIG. 11B, however, with the string in the unlocked or released position.

Each device, as can be noted in FIGS. 11B and 11C includes a bracket 252 secured to and projecting from the end of the neck 204. An L-shaped lever 254 is pivotally connected by a pin 256 to the bracket 252 at the end of the bracket spaced from the neck 204. The L-shaped lever 254 has a first arm 258 extending generally upwardly from the pivot pin 256 as shown in FIG. 11B. The other or second arm 260 of the lever extends from the pivot pin 256 toward the end of the neck 204.

String 206 is secured into a slotted opening 262 in the free end of the first lever arm 258. A first thumb screw 264 is in threaded engagement with the free end of the first lever arm 258 and secures the string 206 in position. A second thumb screw 264*a* is located on the first arm 258 adjacent the first thumb screws 264 and closer to neck 204. Second thumb 206 and affords a fine tuning of the string after the coarse tuning by the first thumb screws.

Figure 11D:
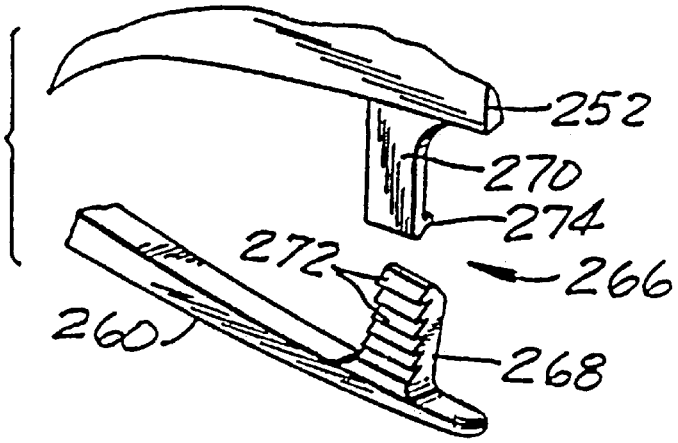
FIG. 11D is a detailed view, on an enlarged scale, on a locking means for the device.

Adjacent the end of the second lever arm 260 spaced from the pivot pin 256 is a forceps-like clamp 266, also shown in greater detail in FIG. 11D. The clamp includes a first part 268 secured to the second lever arm 260 and a second part 270 secured to and projecting downwardly from the bracket 252. As can be seen best in FIG. 11D, the first part 268 of the clamp has a plurality of serially arranged teeth 272 for interlocking with a corresponding tooth 274 on the second part 270.

In FIG. 11B the clamp 266 is closed, securing the string in the locked position. By opening the clamp 266, as shown in FIG. 11C, the lever 254 can be pivoted about the pin 256 so that the tension in the string 206 is released. With the plurality of teeth 272 on the first part 268 the interengagement of one of the teeth of 272 with the corresponding tooth 274 affords a variable adjustment in the tension acting on the string 206.

As can be noted in the drawing, the end of the string 206 secured by the first thumb screw 264 is adjacent to the nut 210 so that there is little bending in the string.

The spacing between the teeth 272 is selected so that the difference in tension imparted to the string affords specific pitch changes taking into consideration the stretch characteristics of the string.

While the vibration or resonance control is described above with respect to an electric or an acoustic guitar and to a microphone or speaker frame, it can be readily appreciated that the use of the basic concept is applicable to a broad range of musical instruments and other apparatus or devices where vibrational control is important for the operation of the musical instrument or of the apparatus or device.

While specific embodiments of the invention have been shown and described in detail to illustrate the application of the inventive principles, it will be understood that the invention may be embodied otherwise without departing from such principles.

I claim:

1. A stringed musical instrument comprising an elongated neck and body attached to one end of said neck, a bridge-tailpiece assembly mounted on said body, a plurality of elongated strings, means on said neck for supporting and forming a first critical point for each of said strings, said bridge-tailpiece assembly forming a support and second critical point for each of said strings, said bridge-tailpiece assembly comprising a fulcrum tremolo, said fulcrum tremolo including bearing means mounted on said body and supporting said fulcrum tremolo for pivotal displacement, wherein said bearing means comprises at least one ball bearing member, and a bearing housing adjustably mounted on said body, wherein said ball bearing member is mounted in said bearing housing and a shaft is connected to said fulcrum tremolo, said fulcrum tremolo including means for adjustably mounting said bearing housing on said body for adjustably positioning said bearing housing relative to the body.

2. A stringed musical instrument as set forth in claim 1 wherein said means for adjustably mounting said bearing housing comprises a post threadedly connected to said body and engaged with said bearing housing so that said post is adjustably threaded in said body for adjusting the position of said bearing housing relative to said body.

3. A stringed musical instrument as set forth in claim 2 wherein said post has an annular flange thereon supporting said bearing housing for moving said housing relative to said body.

4. A stringed musical instrument comprising an elongated neck and body attached to one end of said neck, a bridge-tailpiece assembly mounted on said body, a plurality of elongated strings, means on said neck for supporting and forming a first critical point for each of said strings, said bridge-tailpiece assembly forming a support and second critical point for each of said strings, said bridge-tailpiece assembly comprising a fulcrum tremolo, said fulcrum tremolo including bearing means mounted on said body and supporting said fulcrum tremolo for pivotal displacement, wherein said bearing means comprises at least one ball bearing member, said fulcrum tremolo further comprising a plurality of individual adjustable intonation modules mounted on a base plate, each of said intonation modules comprising a base member and a bridge element, each said bridge element having a curved surface for supporting one of said strings at the second critical point, and at least one individual intonation module having an elongated member pivotally connected to said base member and having a passage therethrough for receiving said string supported on said bridge element, said elongated member located on the opposite side of said bridge element from the first critical point.

5. A stringed musical instrument as set forth in claim 4 wherein means are mounted on said base member and in engagement with said elongated member for pivotally displacing said elongated member and varying tension on the string passing through said elongated member.

6. A stringed musical instrument as set forth in claim 5 wherein said means for pivotally displacing said elongated member comprises an adjustment bolt extending in the elongated direction of said elongated member and in threaded engagement with said base member, said adjustment bolt extending through into bearing contact with said surface of said elongated member with said surface extending generally in the elongated direction of said elongated member.

7. A stringed musical instrument as set forth in claim 4 including shim means for one of said intonation modules, said shim means being located between said one intonation module and said base plate for adjusting the vertical displacement of the bridge member relative to the base plate.

8. A stringed musical instrument comprising an elongated neck and a body attached to one end of said neck, a bridge-tailpiece assembly mounted on said body, a plurality of elongated strings, means on said neck for supporting and forming a first critical point for each of said strings, said bridge-tailpiece having a plurality of bridge elements, said plurality of bridge elements each having a surface forming a second critical point for each of said strings, said bridge-tailpiece assembly comprising a fulcrum tremolo having a fulcrum axis, said bridge elements being pivotably displaceable by an essentially constant radius about said fulcrum axis, wherein at least one of said bridge elements has an enlarged curved surface and said enlarged curved surface extending generally in the direction of said strings, said second critical point travels a critical distance along the surface of said enlarged curved surface and displaces the second critical point from said essentially constant radius during the pivoting of said fulcrum tremolo about said fulcrum axis.

9. A stringed musical instrument as set forth in claim 8 wherein said enlarged curved surface has a different radius of curvature on the opposite sides of one position of said second critical point which changes over at least a critical distance sufficient to control the changing of the harmonic tuning of said musical instrument during the pivoting of said fulcrum tremolo device.

10. A stringed musical instrument as set forth in claim 9 wherein said enlarged curved surface has a first end closer to said first critical point and a second end more remote from the first critical point and said enlarged curved surface has a decreasing radius from the first end to the second end thereof.

11. A stringed musical instrument as set forth in claim 9 wherein said enlarged curved surface has a first end closer to said first critical point and a second end more remote from the first critical point and said enlarged curved surface has an increasing radius from the first end to the second end thereof.

12. A stringed musical instrument as set forth in claim 9 wherein each of said strings has a different rate of stretch and said enlarged curved surface varies to compensate for the rate of stretch of at least one of said strings.

* * * * *

US006175066C1

(12) EX PARTE REEXAMINATION CERTIFICATE (8301st)

United States Patent

McCabe

(10) Number: US 6,175,066 C1

(45) Certificate Issued: Jun. 7, 2011

(54) TUNING MEANS FOR STRINGED MUSICAL INSTRUMENT

(76) Inventor: Geoffrey McCabe, New York, NY (US)

Reexamination Request:
No. 90/011,375, Dec. 7, 2010

Reexamination Certificate for:

| | |
|---|---|
| Patent No.: | **6,175,066** |
| Issued: | **Jan. 16, 2001** |
| Appl. No.: | **08/027,729** |
| Filed: | **Jan. 14, 1993** |

Related U.S. Application Data

(62) Division of application No. 07/607,458, filed on Oct. 31, 1990, now Pat. No. 5,198,601.

(51) Int. Cl.
*G10D 3/14* (2006.01)
*G10D 3/00* (2006.01)

(52) U.S. Cl. ..... 84/313; 84/298; 84/307

(58) Field of Classification Search ..... None
See application file for complete search history.

(56) References Cited

U.S. PATENT DOCUMENTS 4,967,631 A 11/1990 Rose ..... 84/313

*Primary Examiner*—Fred Ferris

(57) ABSTRACT

A stringed instrument is provided wherein each string has two critical points. A fulcrum tremolo is mounted on the instrument for varying the tension of the strings and the distance between the two critical points. The strings are attached to a plurality of intonation modules mounted on the fulcrum tremolo. Each intonation is adjustable so that the strings can be adjusted from an untensioned state to a proper playing pitch. A bearing assembly is also included to facilitate pivoting of the fulcrum tremolo.

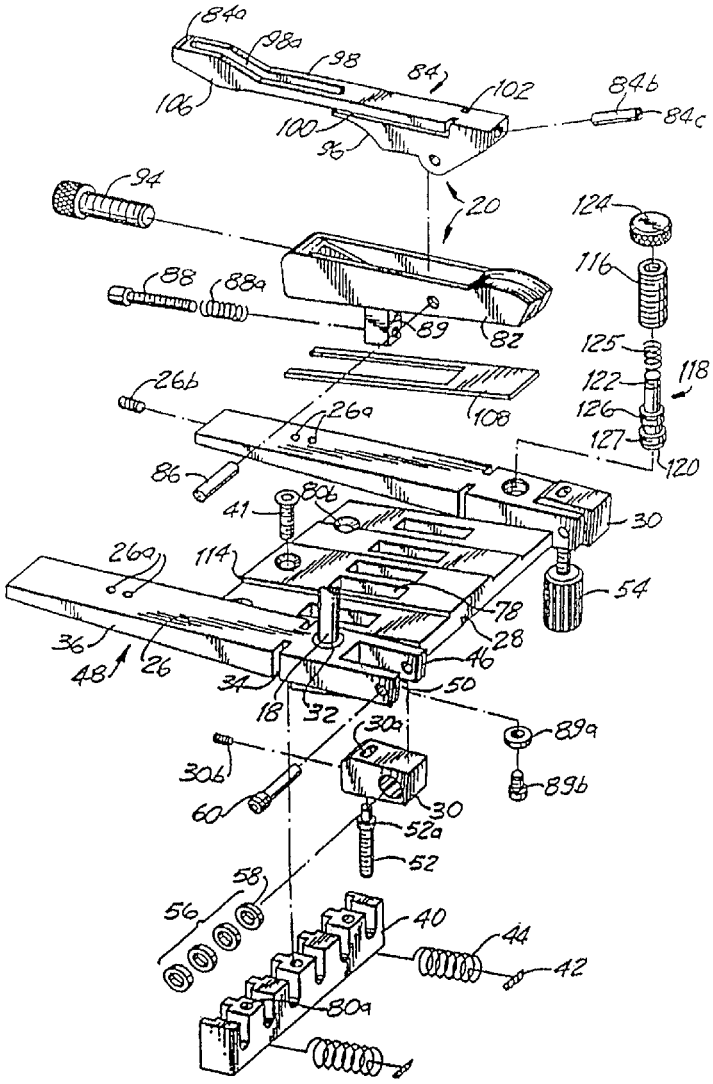

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 8-12 is confirmed.

Claims 1-7 were not reexamined.

* * * * *